US010932983B2

(12) United States Patent
Johnson

(10) Patent No.: US 10,932,983 B2
(45) Date of Patent: Mar. 2, 2021

(54) TORSO BAR WALKER

(71) Applicant: NEUROMOBILITY LLC, Coupeville, WA (US)

(72) Inventor: Cynthia Louise Johnson, Coupeville, WA (US)

(73) Assignee: NEUROMOBILITY LLC, Coupeville, WA (US)

( * ) Notice: Subject to any disclaimer, the term of this patent is extended or adjusted under 35 U.S.C. 154(b) by 0 days.

(21) Appl. No.: 16/371,707

(22) Filed: Apr. 1, 2019

(65) Prior Publication Data

US 2019/0388293 A1 Dec. 26, 2019

Related U.S. Application Data

(63) Continuation-in-part of application No. 15/970,538, filed on May 3, 2018, now Pat. No. 10,543,144, which is a continuation-in-part of application No. PCT/US2016/060411, filed on Nov. 3, 2016.

(60) Provisional application No. 62/650,793, filed on Mar. 30, 2018, provisional application No. 62/250,291, filed on Nov. 3, 2015.

(51) Int. Cl.
*A61H 3/04* (2006.01)

(52) U.S. Cl.
CPC ..... *A61H 3/04* (2013.01); *A61H 2003/046* (2013.01); *A61H 2201/1619* (2013.01)

(58) Field of Classification Search
CPC ..... A61H 3/04; A61H 2003/046; A61H 2201/1619
See application file for complete search history.

(56) References Cited

U.S. PATENT DOCUMENTS

| | | | | |
|---|---|---|---|---|
| 5,275,426 | A * | 1/1994 | Tankersley | A61H 3/008 135/67 |
| 5,476,432 | A | 12/1995 | Dickens | |
| 5,732,964 | A | 3/1998 | Durham et al. | |
| 6,343,802 | B1 | 2/2002 | Workman et al. | |
| 6,733,018 | B2 | 5/2004 | Razon | |
| 7,275,554 | B2 * | 10/2007 | Mullholand | A61H 3/008 135/67 |
| 7,422,550 | B1 | 9/2008 | Pinero et al. | |

(Continued)

FOREIGN PATENT DOCUMENTS

| | | | |
|---|---|---|---|
| DE | 10 2008 029 564 | B4 | 12/2015 |
| WO | WO 2913/029578 | A1 | 3/2013 |

*Primary Examiner* — Bryan A Evans
(74) *Attorney, Agent, or Firm* — Fay Sharpe LLP

(57) ABSTRACT

A mobility aid includes two side frames, each configured for contact with a hand or forearm of associated user; an interconnecting frame member; two or more wheels; one or two adjustable torso bars attached to side frames, and each variably including a posterior member for maintaining consistent contact of torso with the anterior member. Flexed posturing and abnormal lower body biomechanics are common with use of wheeled walking aids managed by the upper body. Users typically excessively push down and forward to advance device. The novel body engaging member(s) enable the presented device to be advanced by torso contact as the user walks. Upper body weight bearing is thereby minimized. Propulsion is enhanced as user advances the pelvis against the torso bar(s). Posture is improved and safety is increased. A walker is provided for users requiring, or training to achieve, light upper body support.

21 Claims, 21 Drawing Sheets

(56) References Cited

U.S. PATENT DOCUMENTS

| | | | | |
|---|---|---|---|---|
| 9,649,243 | B2 * | 5/2017 | Johnson | A63B 69/0064 |
| 2005/0156395 | A1 | 7/2005 | Bohn | |
| 2006/0206167 | A1 * | 9/2006 | Flaherty | A61H 1/0255 607/48 |
| 2008/0079230 | A1 | 4/2008 | Graham | |
| 2009/0224499 | A1 | 9/2009 | Dashew et al. | |
| 2010/0100013 | A1 * | 4/2010 | Hu | A61H 3/00 600/595 |
| 2015/0216757 | A1 | 8/2015 | Powell et al. | |

* cited by examiner

TORSO BAR WALKER

This application claims the priority benefit of U.S. provisional application Ser. No. 62/650,793, filed Mar. 30, 2018, and is a continuation-in-part of pending U.S. application Ser. No. 15/970,538, filed May 3, 2018, which is the national entry filing of PCT/US2016/060411, filed Nov. 3, 2016, which claims the priority benefit of U.S. provisional application Ser. No. 62/250,291, filed Nov. 3, 2015, the entire disclosures of each of which are expressly incorporated herein by reference.

BACKGROUND

This disclosure is directed to assistive devices for mobility, specifically wheeled devices used for ambulatory support.

Mobility aids used for ambulatory support are typically managed by one or both of a user's upper extremities (UE). Users maintain bodily contact with devices by gripping one or two gripping surfaces and/or by placing one or both forearms on forearm supports. Walkers without wheels are called pick up walkers (PUW). PUW are necessarily managed by the UEs as they are lifted off of the ground by the user and subsequently advanced in order to enable stepping. Walkers with wheels on the front legs are called front wheeled walkers (FWW).

Rollators are devices with three or four (4) wheels. Typically, caster wheels are fit on the front legs and standard wheels on the rear. Rollators are inherently less stable than FWW.

Gait trainers are wheeled devices prescribed for children and adults with physical disabilities to enable independent walking or for training in safe and efficient gait. Positioning and supportive components can often be incrementally added to the frames as needed for postural support and LE deweighting to enable stepping. Frames which incorporate upper extremity support surfaces/assemblies, used for walking without deweighting components, are frequently excessively managed by the upper body. Forward leaning and excessive weight bearing through the hands or forearms to advance these devices frequently occurs when the devices are configured to be managed by the UEs.

Devices with wheels are advanced by rolling the device with all legs and/or wheels remaining in contact with the ground. When needed for light support and when used properly, the user maintains consistent positioning relative to the device with erect posture and with UEs supported lightly. The device advances as the user takes steps and UEs are in contact with the device.

Use of devices such as walkers managed by the UE is particularly problematic related to the prevalent problem of excessive compensatory use of the UE for control and stability and associated flexed posturing, device positioned excessively forward relative to user, excessive upper body weight bearing and associated abnormal lower body functioning. Abnormal biomechanics impacts safety when walking, impairs gait rehabilitation efforts, is known to negatively impact neurologic recovery of locomotor function, and results in decline of lower body function. The goal when walking is to generate lower extremity (LE) propulsive forces. This would be enhanced in presence of a frame member optimally positioned for anterior pelvic contact.

Incorporation of bilateral forearm support assemblies facilitates improved posture when used correctly and when light UE support is needed, yet does not provide a solution for flexed posture and safety when increased upper body support is needed. When light support is needed, the prevalent tendency remains to excessively manage wheeled devices with the upper body and to excessively bear weight through forearm supports. Advancement of the device via torso contact is needed.

There are several reasons that poor technique with walker use may occur.

LE function may be inadequate to take steps with erect posture and normal LE biomechanics.

Users may conceive that UE weight bearing is advisable when using wheeled devices. Users may excessively consider that these devices are meant to provide considerable support.

Other users may be accustomed to observing the prevalent poor posturing of walker and rollator users and consider this unavoidable. In addition, users may not understand the detrimental effects of using devices in this way.

Many people inaccurately consider that weakening of the body necessarily occurs as one ages and accept that posture and gait quality deteriorate, particularly when a walker is deemed needed.

From an early age, humans are taught to push wheeled devices equipped with handles. Management style with wheeled devices is typically to push downward and excessively bear weight with the UEs.

Education in proper technique by those recommending the use of these devices may be lacking.

Users yield to the forces of gravity and fail to exert the effort required to counteract this.

Device designs may encourage less than optimal biomechanics.

Excessive upper body weight bearing is associated with UE overuse injuries.

Flexed posture is associated with spinal dysfunction, impaired balance, disruption of gait biomechanics, compression of the cardiorespiratory system, decreased visual interaction with the environment, and more.

Orthopedic patients need a simple training device which encourages increased hip and knee range of motion and optimal LE functional strengthening with use. Current devices are inadequate in this regard.

Established locomotor training principles known to enhance neurologic recovery include, in part, normalizing lower body function, improving spinal posture, reducing upper body weight bearing. Adhering to these and other principles is challenging with currently available overground mobility aids. This invention and Johnson's device provide solutions.

For a similar power output or similar volume of work performed, demands on the cardiorespiratory system are greater when the work is performed by the UEs compared to that when performed by the LEs. Excessive upper body work is undesirable in terms of gait efficiency as well as in the presence of various disease states. Conservation of energy and efficiency of movement are desirable and are negatively impacted with excessive, unnecessary upper body work. A simple mechanical means to reduce excessive UE work during walking is needed.

Walking with outstretched UEs and flexed posture with a mobility aid displaces the body's center of gravity (COG) anteriorly and displaces laterally when turning. Stability and safety are decreased when the COG falls outside of the base of support, particularly when the device has wheels.

Users often demonstrate unsafe turning technique with walkers and rollators. Feet can become positioned too far forward or back within the frame, and base of support can narrow. It would be desirable to have a mechanical means for consistent bodily positioning to enhance safety while turning.

Currently, ambulatory ability with a wheeled device in part reflects upper body functional status. It would be desirable for several reasons to have a device which when used primarily reflects lower body functional status.

Walkers and rollators managed by the upper body require good and symmetrical upper body function for safe and effective use. It would be desirable to have a device advanced via contact with the torso.

Management of wheeled mobility aids by the upper body represents dual tasking while walking and thus increases cognitive demands. For some, this may distract from necessary focus on lower body function, that which is necessary to walk safely or to improve gait. It may add confusion and increase fall risk. It would be desirable to be able to reduce these demands.

Falls present a major problem in our society and associated injuries are responsible for vast amounts of medical spending. It is commonly known that the majority of falls occurs with walkers. This invention may assist in reducing fall risk for reasons associated with above factors.

Gait quality and safety are increasingly compromised when additional upper body weight bearing is needed when using wheeled devices. Upper body forces are necessarily angled downwards in order to simultaneously advance the device. Posture typically becomes excessively flexed as upper body weight bearing is increased. Both UE provide support for each of the lower extremities (LE) as opposed to an UE supporting the opposite LE as can be performed with crutches. Solutions are needed to enable improved biomechanics when walking with walkers in the presence of need for additional upper body support.

Johnson's Reciprocating Arm Motion Walker U.S. Ser. No. 15/970,538, filed May 3, 2018, and WO 2017079491 (PCT/US2016/060411 that claims the priority benefit of U.S. provisional application Ser. No. 62/250,291, filed Nov. 3, 2015)('the '538 application), provides such a solution. UE support assemblies are mobile upon a fixed frame. Each UE can be advanced in turn, simultaneously with the opposite LE (2 point gait) or in advance of the opposite LE (4 point gait; 4 distinct points of contact with the ground) such as can be performed with crutches. The device is advanced via contact of the moving body with a novel horizontal frame member. Gait biomechanics are significantly normalized compared to walking with a wheeled device managed by the upper body. UE forces can be directed vertically, supporting the opposite LE to the extent needed, whilst maintaining erect posture. Improved 3 point step to and step through gait patterns can also be performed with this device, when simultaneous support of both UEs is desirable.

The device described in the '538 application also enables freely reciprocating UE movement such as can be performed, and is desirable, when a wheeled device is introduced for light support. Propagation of the device is independent of UE movement. The device is advanced via bodily contact with the horizontal frame member. Upper and lower body gait biomechanics are thus improved. UE support assemblies can variably be statically positioned when this is appropriate.

Bilateral torso bar designs such as presented in this invention could be integrated into the reciprocating arm motion walker of the '538 application in place of the one piece torso bar incorporated into the original designs.

SUMMARY OF THE DISCLOSURE

Several different design options for a feature and related method is provided for various types of wheeled mobility aids to enable the selected device to be advanced preferentially via contact with the torso instead of by the upper extremities.

This invention provides a more effective way to walk with a wheeled device, particularly when the device is needed for light support.

The invention will be used as a gait training device and as a mobility aid to be used intermittently or on a permanent basis.

Falls present a major problem in our society and associated injuries are responsible for vast amounts of medical spending. It is commonly known that the majority of falls occurs with walkers. This invention may assist in reducing fall risk. It may be useful to screen for adequate lower body function as needed to walk safely with a selected type of wheeled device. Sufficient lower body function is required to propagate a torso bar walker. An individual who is able to walk by excessively managing a device with the upper body, yet is unable to walk with this invention, may be deemed to be at greater risk for falling.

This invention provides for the following benefits: reduction of excessive upper body management of the device and associated problems; facilitation of improved lower body function with implications for LE strengthening, gait quality, neuro-recovery, stability, safety.

BRIEF DESCRIPTION OF THE DRAWINGS

FIG. 12B has curved telescoping bilateral torso bars, and enhanced bodily contact is enabled by lengthening the bars, and height adjustability is represented by the vertical arrow above a vertical tube which serves to connect the torso bar to the frame, FIG. 12C has caliper bilateral torso bars each of which can be adjusted to accommodate a larger hemipelvis, and FIG. 12D has V-shaped bilateral torso bars where dotted lines illustrate alternate positioning for positioning feet of the associated user farther forward within the frame.

FIG. 14A shows an alternate frame design with a grip handle where the handle is attached to the frame by a vertical attachment member, a ball joint attaches the handle to a vertical member, and the handle is shown on one side for ease of illustration; FIG. 14B is an alternate frame design with a U-shaped wrist support with adjustable grip handle, and the handle shown on one side for ease of illustration; FIG. 14C is an alternate frame design with the grip handle positioned at a terminus of a bar which is attached to a vertical extension tube on the frame, and again the handle is shown on one side for ease of illustration; and FIG. 14D is yet another alternate frame design with bilateral forearm support assemblies, and a forearm trough is shown on one side for ease of illustration.

DETAILED DESCRIPTION

Figure 1:
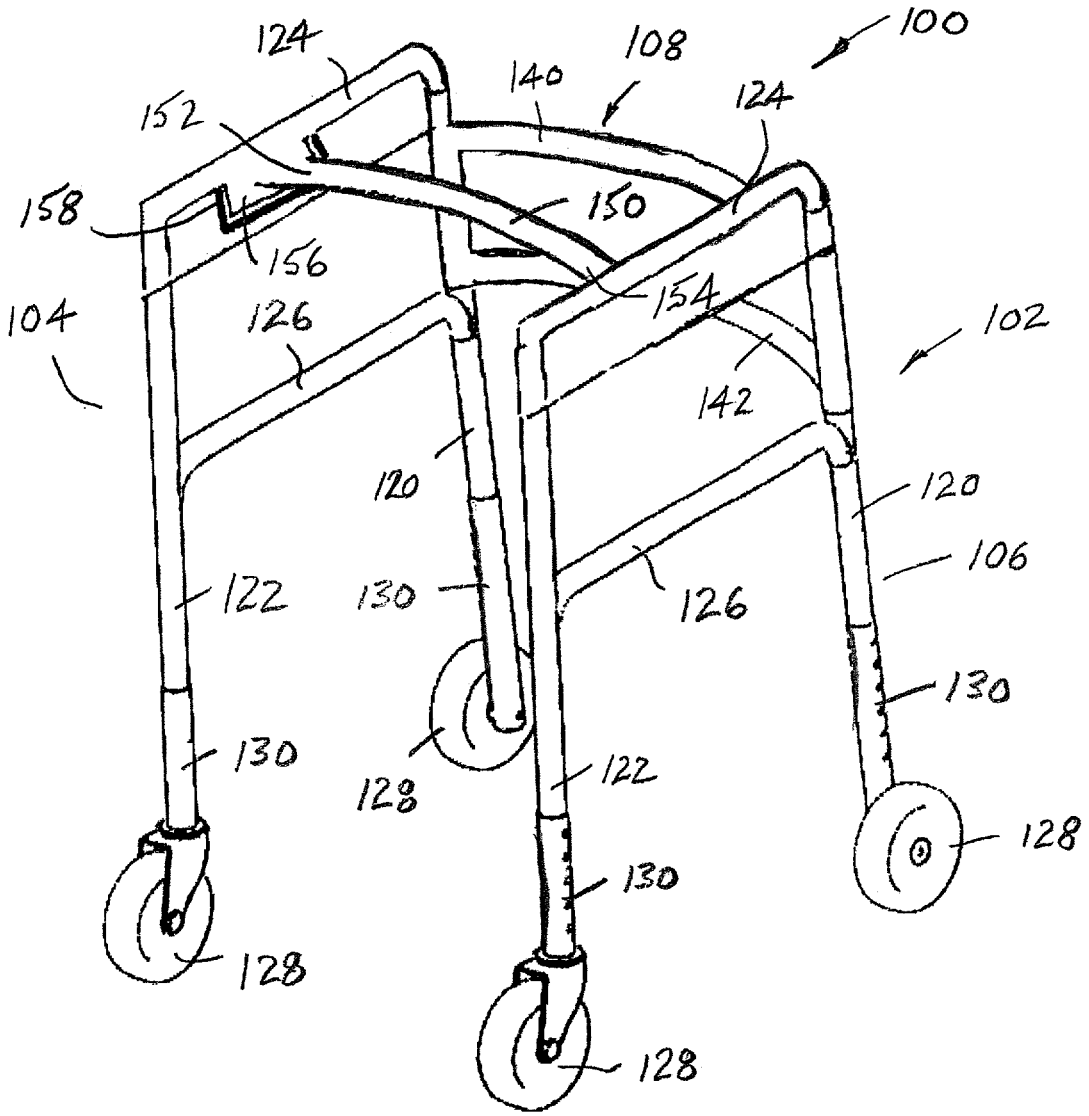
FIG. 1 shows a rendering of a four wheeled walker frame with removable torso bar.

This invention describes features which can be permanent or removable, and added to wheeled device frames with minor design modifications or incorporated into new designs. The invention is functional on wheeled mobility aids with two, three, or four wheels. Surfaces which facilitate gliding can selectively be introduced to the rear legs of two wheeled devices as needed or desired. It is also understood that the invention is applicable to a pick-up walker (i.e., no wheels) where the torso bar is not used for advancing the mobility aid but the torso bar is particularly useful to provide proper positioning of the associated user when using the pick-up mobility aid/walker.

One or more components ('bars') are securely fastened to any of various locations on the frame for purposes of providing contact points with the user's torso, preferably at the level of the pelvis. Bars presented in the drawings are attached to the side frames. Several different attachment mechanisms can be conceived and are not presented in detail here. Contact with the upper torso progressively may encourage forward flexion of the trunk and therefore would not be desirable.

Components could be made of any of several different types of material and in any of several different forms. Padding can be variably introduced to the bars, and conceivably incrementally added for comfort and to accommodate a range of body shapes and sizes.

Bar(s) contacting the anterior torso can be used with or without a belt or some other component contacting the posterior torso ('posterior components'). Posterior components facilitate keeping body in contact with the bar(s) and offer a surface to push against for steering and walking backwards.

One piece torso bars span the frame of the device, are positioned parallel to the ground, and can be curvilinear or straight. Circular tubing with or without padding is incorporated in the one piece torso bar walkers illustrated. Steering of the device is enhanced when bar is more congruent with shape of the torso. Fore-aft and vertical adjustability would be desirable. Designs with fixed fore-aft positioning will strive for optimal fit for the majority of users.

Variably, a torso bar can project from each of the two side frames for contact with each side of the torso. Multiple positioning options of the bars can be conceived of. These are referred to as bilateral torso bar designs. An anterior member/component of each bar can be used with or without a posterior member, depending on user's needs or desires. Posterior members function similarly to that described above for the unilateral bar design. Preferably, the two torso bars are at the same height and extend the same dimension from the respective side frame, although it is recognized that the two torso bars could be offset in height or could extend different lengths from the side frames as needed for specific patient/user situations without departing from the scope and intent of the present invention.

Ideal positioning of the feet within a walker varies, depending on physical and functional characteristics of the user. Fore-aft adjustability of the bar(s) is desirable to accommodate this. One could consider torso bar walker designs in which bar(s) could be positioned excessively posterior in order to accommodate users accustomed to standing excessively far from the walker. The bar could be progressively moved forward as training progressed and UE weight bearing was reduced.

Vertical adjustability enables positioning at the preferred level of the torso. Again, contact with the pelvis is most desirable as described below related to functionality.

Bilateral designs such as a U- or V-shaped or caliper design could be created which enable adjustment for variable pelvic width.

Varying degrees of freedom of movement at the connections between torso bar(s) and the frame could be integrated. A rigid connection would serve to immediately cause the device to advance, when in contact with a moving body. Torso bar(s) with nonrigid connections may be useful for accommodating movement of the body relative to the device, such as with terrain changes, gait variations, and other.

Wheel configuration of four wheeled devices typically includes placement of swivel wheels on the front legs to facilitate turning. Users are heretofore accustomed to steering a device whilst pushing it excessively with the UEs. Turning with caster wheels on the rear is performed by turning the rear end of the device and this may be facilitated when movement of the body is more involved with managing the device. In terms of forward progression, standard wheels on the front may also create a more stable device.

Weights could be incrementally added to the frame for adding resistance to forward progression. Adding weight increases the force production required of the lower body to advance the device and therefore provides for a unique training option.

Auditory cuing devices could be integrated into the torso bar(s) for biofeedback to encourage contact, and to enhance contact forces.

The features serve to enable propagation and steering of the device via torso contact to the extent the user remains in contact with the features while walking.

The position of the bar(s) relative to the frame determines foot positioning and where bar(s) contact the body. Adjustment of position enables optimizing for comfort, fit, and function.

Consistent foot and bodily positioning is accomplished by keeping body in contact with the anterior bar.

The objective is to push the body forward against the bar(s) and to rest the UEs on the UE supports (grips and/or forearm supports) when walking. Generation of lower body propulsive force is required to advance the device. Horizontally-directed forces cause the device to advance.

Vertical positioning of the bar(s) is most desirable at the level of the pelvis. Forward leaning of the body or spinal flexion may be encouraged when positioned above the pelvis, as the upper trunk is pushing against the bar.

Vertical positioning close to the level of the hip joints may be optimal. During mid to late stance phase in the gait cycle, verbal and proprioceptive feedback provided to the user encourage pushing the pelvis forward against the bar in order to advance the device. In part, hip extension range of motion and muscular activity is thereby enhanced.

Presence of a left and right torso bar (as opposed to a one piece bar) may encourage enhanced pelvic rotation, that which increases gait efficiency and that which may be somewhat restricted related to static positioning of UEs on these devices. Training can include cuing to exaggerate pushing each hemipelvis forward during mid to late stance phase, in reciprocating fashion, as one takes steps.

The need for excessive UE support will prohibit use of the device as described, as this entails standing further away from the device in order to direct significant upper body forces in an angled direction to advance the device.

Sufficient lower body function is required in order to take steps while maintaining bodily contact with a wheeled device with the torso bar. If one can not walk in this manner, and can only walk via excessive UE management, walking with a standard device may not be safe. Related to this, it is proposed that the incorporation of torso bar features will render a device a screening tool for safe walking with the selected type of wheeled device.

The features can be kept in place long term, used for short term gait rehabilitation, or integrated intermittently as needed.

Managing wheeled devices by the UEs requires dual tasking which can be challenging for users with cognitive impairment. This device may reduce cognitive demands. The UEs can rest on the device while the lower body performs habitual stepping.

In FIG. 1, there is shown an assistive walking device such as walker 100 that includes a frame 102 that includes a first side frame portion 104 and a second side frame portion 106. The side frame portions 104, 106 are joined together by a front frame portion 108. More specifically, the side frame portions 104, 106 in this embodiment have the same structural arrangement so that description of what one applies to the other unless noted otherwise. Each side frame portion 104, 106 includes a front leg 120 and a rear leg 122 that are interconnected along an upper region by a hand grip bar 124 and typically an additional side frame bar 126 is provided for added rigidity and strength. Provided at lower ends of each of the front legs 120 and rear legs 122 are wheels 128 (thus four wheels are used in this embodiment—preferably non-swiveling wheels in the front and swiveling or caster wheels in the rear). A conventional height adjustment mechanism 130 is also preferably provided on each leg in order to raise and lower the total height of the walker to accommodate an associated user. The front frame portion 108 interconnects the side frame portions, particularly via front frame bars 140, 142 that extend between the front legs 120. Thus, the front legs 120 form a part of a side frame portion 104 or 106 and the front frame portion 108.

As is well known, and associated user (not shown) typically places the right and left hands and gripping relation with a hand grip bar 124 associated with the side frame portion. As noted above, if the height is not properly set, or the associated user hunches over while using the walker 100, safety, rehabilitation, locomotor function, muscle strength, etc., may be adversely impacted.

A torso bar 150 is incorporated into the structure in accordance with the present disclosure. The torso bar in this embodiment is a single structural component that has a slight curvature where a central portion is disposed forwardly (in a fore/aft direction) of first and second is 152, 154. Each end 152, 154 of the torso bar 150 is attached to a side frame 104, 106, particularly a rectangular plate 156 in the preferred embodiment, which slides into a holder 158 affixed to the inner surface of top portion of side frame. Adjustment of positioning is not possible with this design, although other mounting arrangements that are either fixed or adjustable or contemplated and not deemed to be outside the scope of the present disclosure. Adjustment of the height of the walker is required for adjusting where the torso bar 150 contacts the anterior torso of an associated user. The torso bar 150 can be removed for use of the device as a standard walker 100. The associated user grips the grip handles 124 and positions the body such that the torso bar 150 contacts the anterior torso. Erect posture and proper positioning of the feet is thus achieved.

Swivel wheels 128 are on the rear legs 122 and standard wheels 128 are attached to the front legs 120. This is the configuration incorporated in the '538 application. It creates a more stable device in the presence of reciprocating UE movement. This arrangement also creates a more stable device for forward progression. Turns are performed by stepping in the direction opposite the desired direction of the turn.

Figure 2:
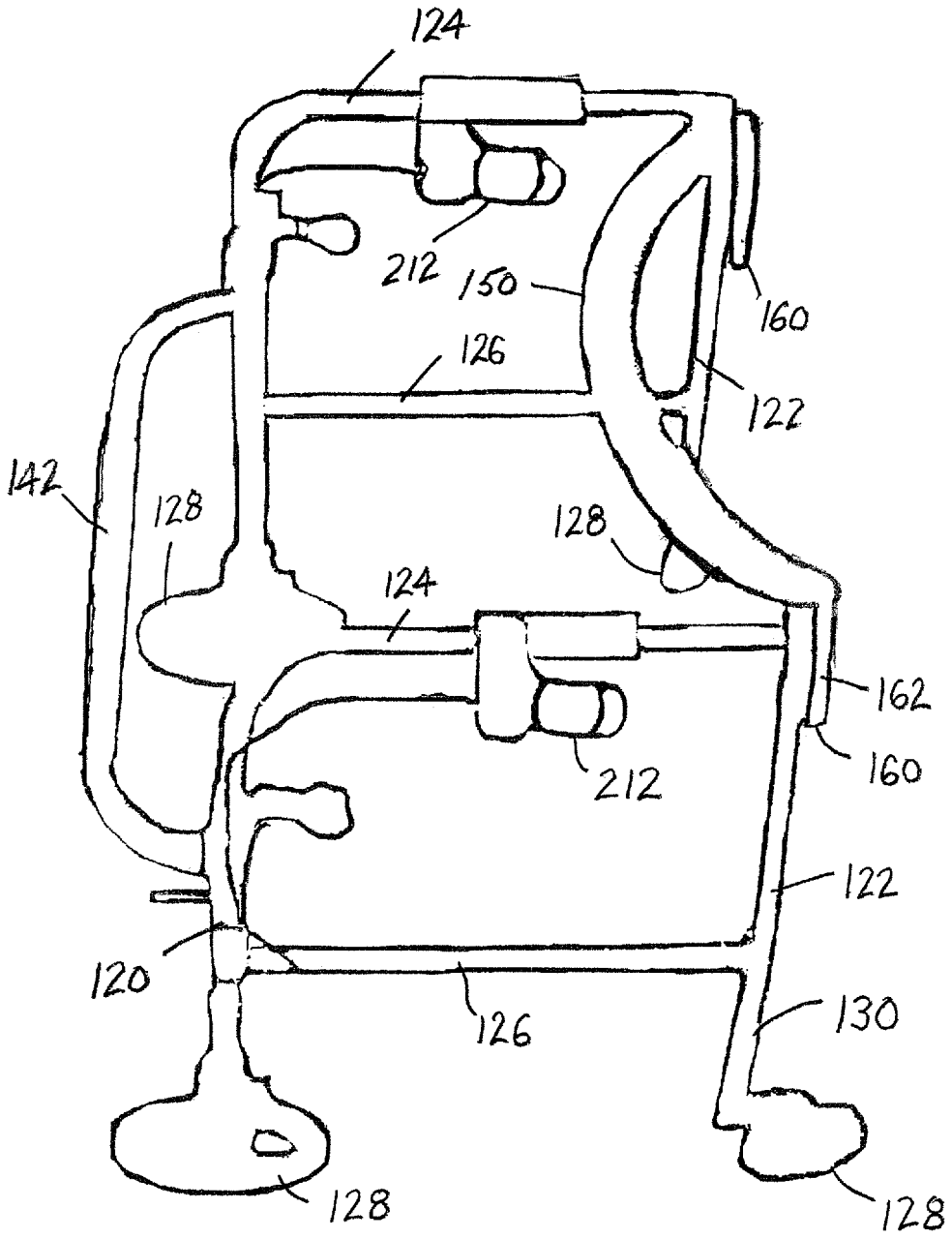
FIG. 2 shows a four wheeled rollator prototype that includes a padded torso bar that is height adjustable, and the assembly is shown without a belt.
Figure 3:
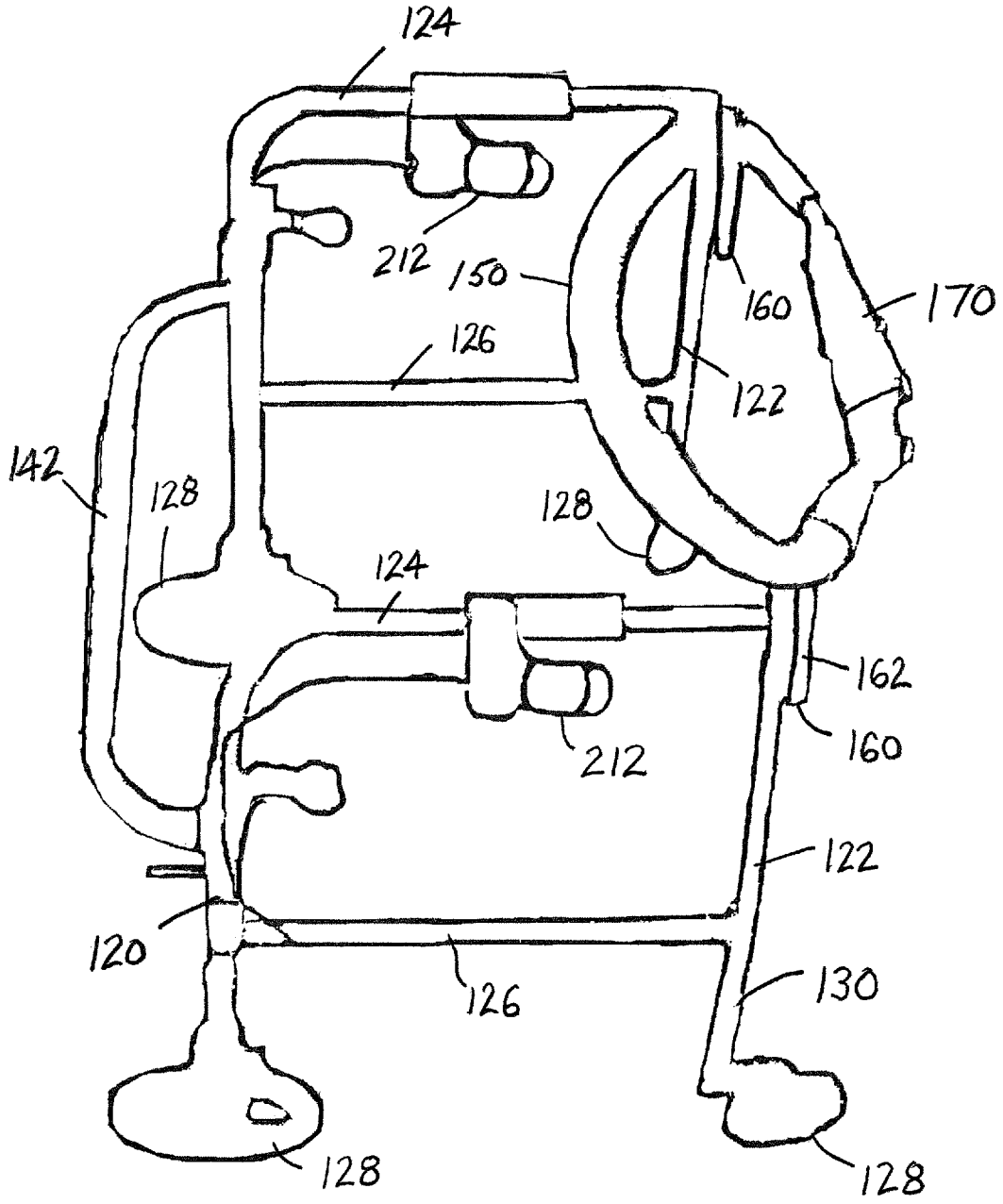
FIG. 3 shows the device in FIG. 2 incorporating a belt.
Figure 4:
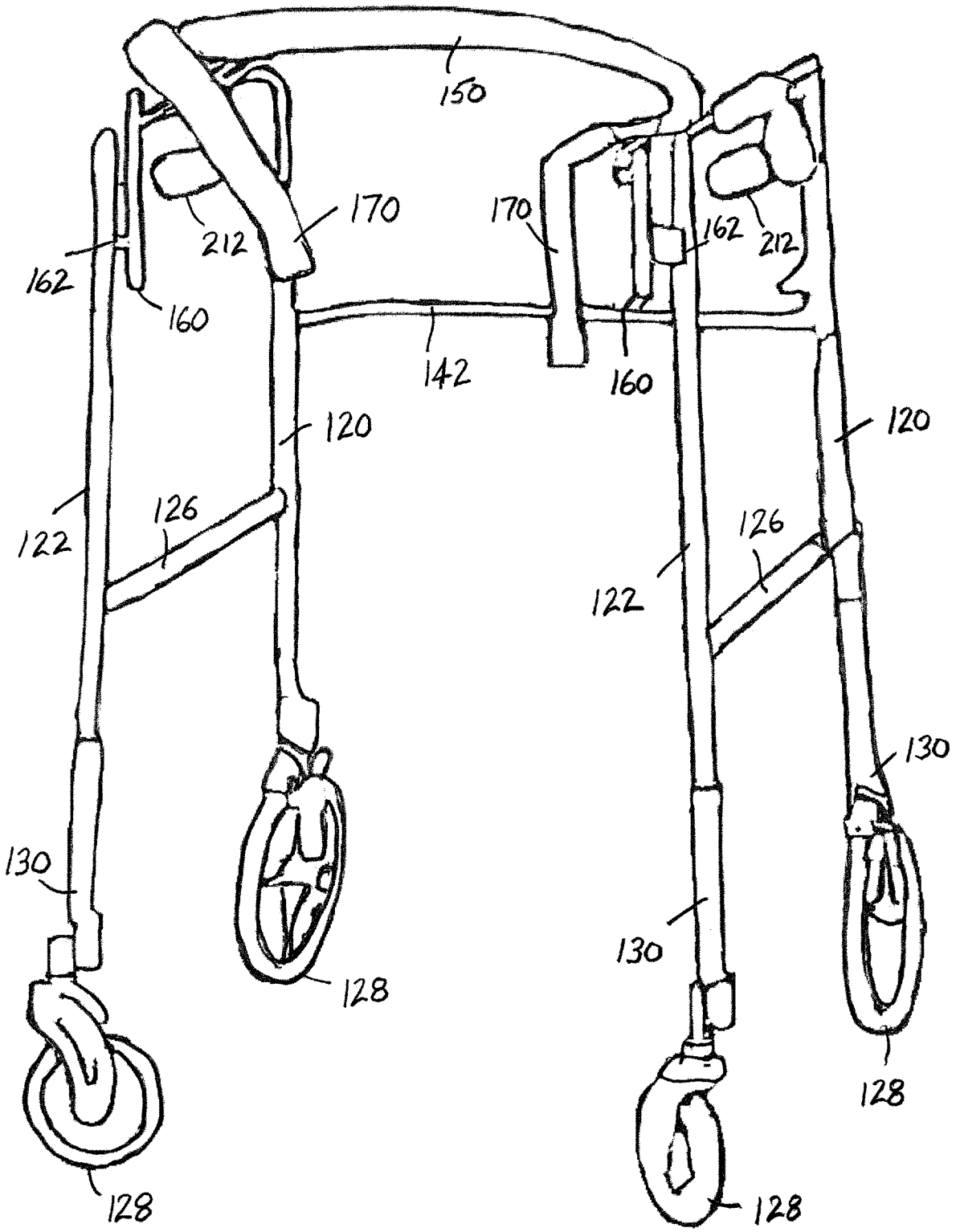
FIG. 4 is a posterolateral view of the device in FIG. 3 where the belt is unhooked.

Another assistive walking device such as a four wheeled walker embodiment of the torso bar walker is shown in FIGS. 2-4. The torso bar 150 in this embodiment is more curved than the torso bar 150 in FIG. 1, and mounted to the frame along the rear legs 122. Bodily contact is enhanced. The torso bar 150 is padded for added comfort. The torso bar 150 can be adjusted vertically by selectively adjusting the position of vertically extending tubes 160 extending from the rear portion of the torso bar 150 within clamps 162 (FIG. 4) attached to the frame 102, specifically to the rear legs 122. In FIGS. 3-4, a belt 170 serves to enhance and maintain bodily contact with the device, thereby reducing the need for the UEs to manage the device. The belt 170 is secured at opposite ends to the frame 102 or torso bar 150 adjacent the torso bar ends 152, 154, and two portions of the belt 170 are selectively joined together on the rear side (posterior side) of the torso of the user once the user is positioned with the front side of the torso against the torso bar 150. With the belt 170 secured around the anterior region of the user's torso, the device 100 and user turn and move as one unit. It is also contemplated that the torso bar 150 could include anterior and posterior portions configured to engage anterior and posterior portions of the torso of an associated user. For example, in addition to the belt 170 used to urge the associated user against the torso bar 150, the torso bar can be formed as multiple portions, such as shown and described below with respect to FIG. 10, FIGS. 12A-12D, or FIGS. 13A-13B.

Figure 5:
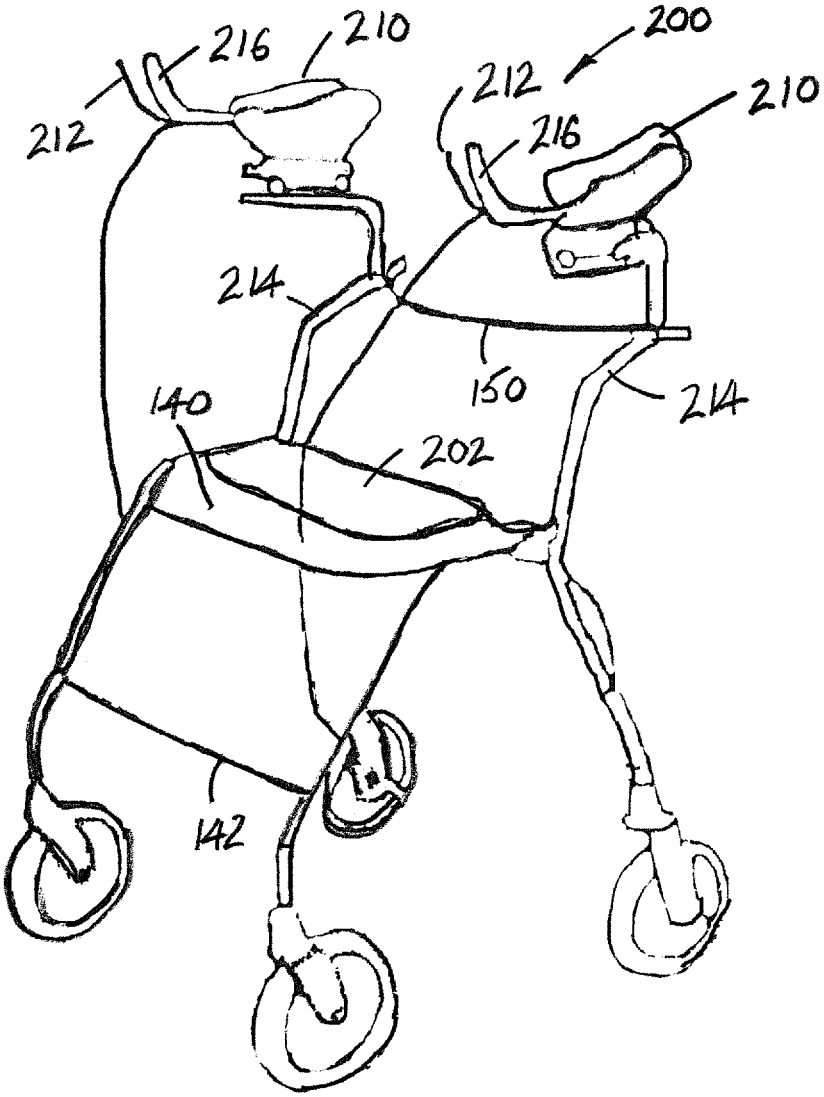
FIG. 5 illustrates a four wheeled rollator with forearm supports, seat, and concept drawing of a one-piece torso bar.

An assistive walking device such as rollator 200 is shown in FIG. 5. For consistency, brevity, and ease of understanding, like reference numerals will be used to refer to like components in the different embodiments of assistive walking devices herein, the new reference numerals refer to modifications of previously described components or new components. The rollator 200 includes a frame 102 that includes first and second side frame portions 104, 106 interconnected along a front frame portion 108. The frame 102 in rollator 200 includes front and rear legs 120, 122 provided as part of each side frame portion 104, 106, and the front legs 120 cooperate with front frame bars 140, 142 to generally form the front frame portion 108. All four wheels 128 are preferably swiveling or caster wheels. The rollator 200 further concludes a seat 202 that extends between the side frame portions and may be hinged along one edge to rotate upwardly and provide selective access to a storage bin 204, or the seat may be non-rotatably fixed to the frame. Bilateral forearm support assemblies 210 and hand brakes 212 are shown in FIG. 5. A torso bar 150 interconnects the vertical frame members 214 to which the forearm supports are attached. In this manner, the torso bar 150 may be a rigid, one-piece component or may be separate torso bar portions as previously noted above. Further, the torso bar 150 is configured for engagement with an interior region of an associated user's torso, and a belt may also be used to extend around the posterior portion of the torso of the associated user. In this manner, the torso of the associated user abuttingly engages the torso bar 150 for advancing the rollator 200, and the forearm support assemblies 210 which include grip handles 216 are used along with the hand brakes 212 to steer the rollator. It is also contemplated that the torso bar 150 could include still other anterior and posterior portions configured to engage anterior and posterior portions of the torso of an associated user. For example, in addition to a belt (not shown) used to urge the associated user against the torso bar 150, the torso bar can be formed as multiple portions, such as shown and described below with respect to FIG. 10, FIGS. 12A-12D, or FIGS. 13A-13B.

Figure 6:
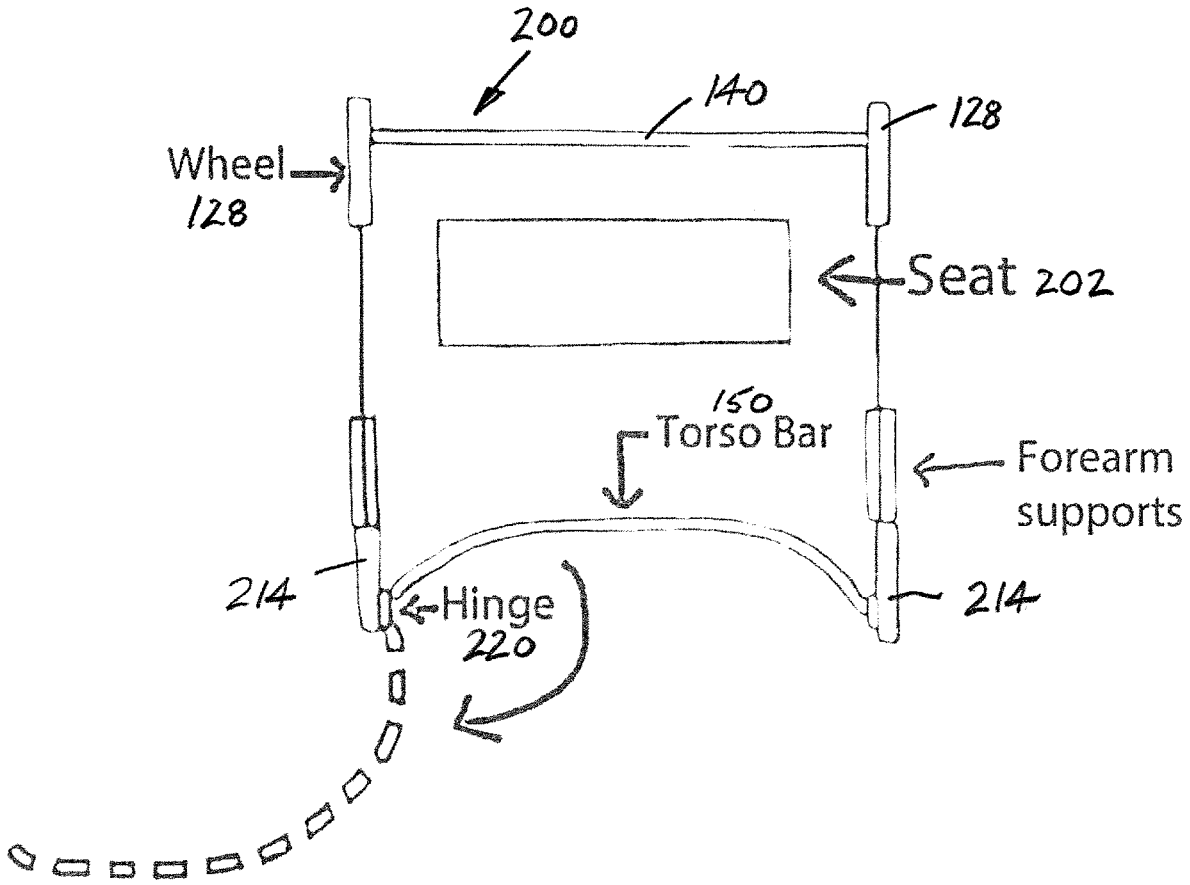
FIG. 6 is a bird's eye view schematically showing the device in FIG. 5 where at least one end of the torso bar is detachable so that the bar can be moved in a transverse plane about a hinge connection to enable a user to turn and sit on the seat.

A schematic illustration in FIG. 6 of a modified torso bar on an assistive walking device such as rollator 200 such as shown in FIG. 5 depicts a torso bar 150 which can be released on at least one side and moved or rotated about a hinge 220 in the transverse plane toward the open end of the device 200, about the vertically directed axis within the hinge mechanism. This enables the user to turn around and sit on the rollator seat 202.

Rollators 200 are typically less stable than walkers related to the presence of four wheels 128 with swivel wheels in the front, and the tendency is to push these devices too far from the body. Stability is enhanced with the torso bar 150 due to consistent proximal positioning of the user to, or contact with, the torso bar along the torso region of the user. Fore-aft bar positioning of the torso bar 150 may be adjusted along frame members 214 for walking up and down inclines and may further optimize rollator walking. Variably, a device may be managed better on hills and uneven terrain by the UEs. LE strengthening may eventually be found to be enhanced with the torso bar rollator 200 as discussed above, hence stability improved.

Figure 7:
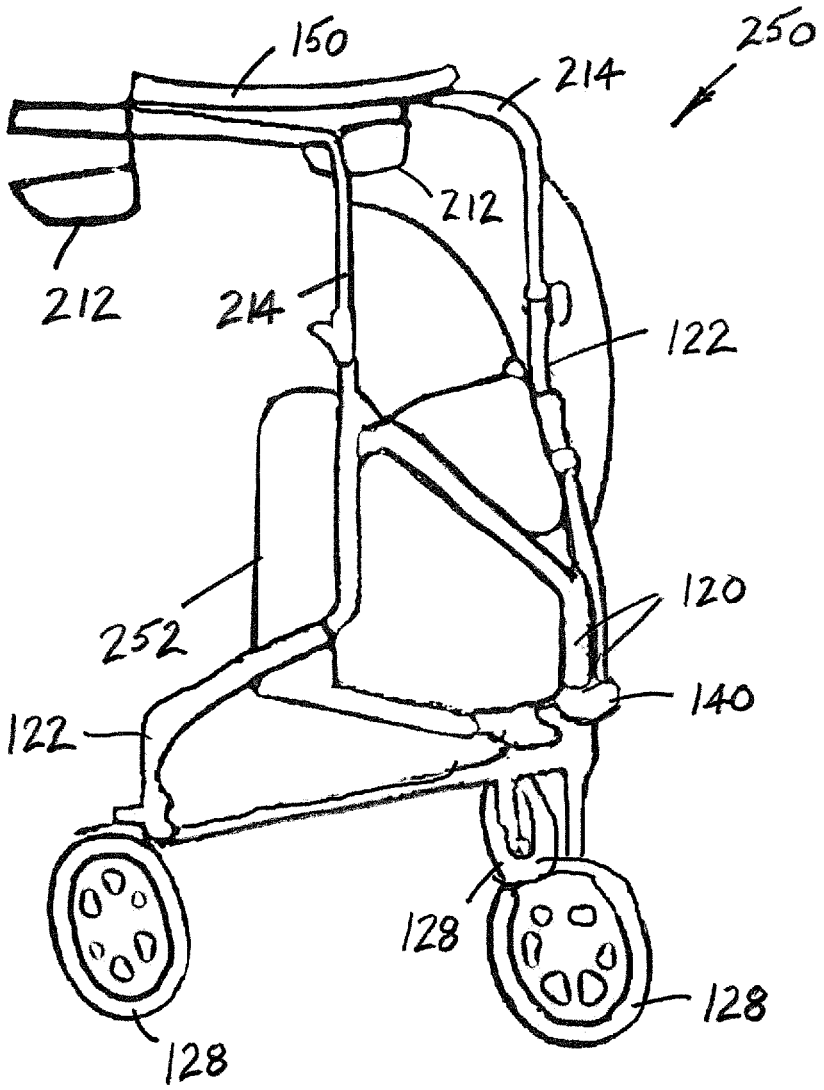
FIG. 7 shows a three-wheeled rollator with the addition of a one-piece torso bar.

An assistive walking device such as three wheeled rollator 250 with a basket 252 is shown in FIG. 7. The rollator 250 includes front leg portions 120, rear leg portions 122, three wheels 128, hand brakes 212, and upper frame members 214. A one-piece curved torso bar 150 is conceptually illustrated and is situated between and slightly above the level of the hand grips. It is also contemplated that the torso bar 150 could include anterior and posterior portions configured to engage anterior and posterior portions of the torso of an associated user. For example, a belt (not shown) could be used to urge the associated user against the torso bar 150, or the torso bar can be formed as multiple portions, such as shown and described below with respect to FIG. 10, FIGS. 12A-12D, or FIGS. 13A-13B.

Figure 8:
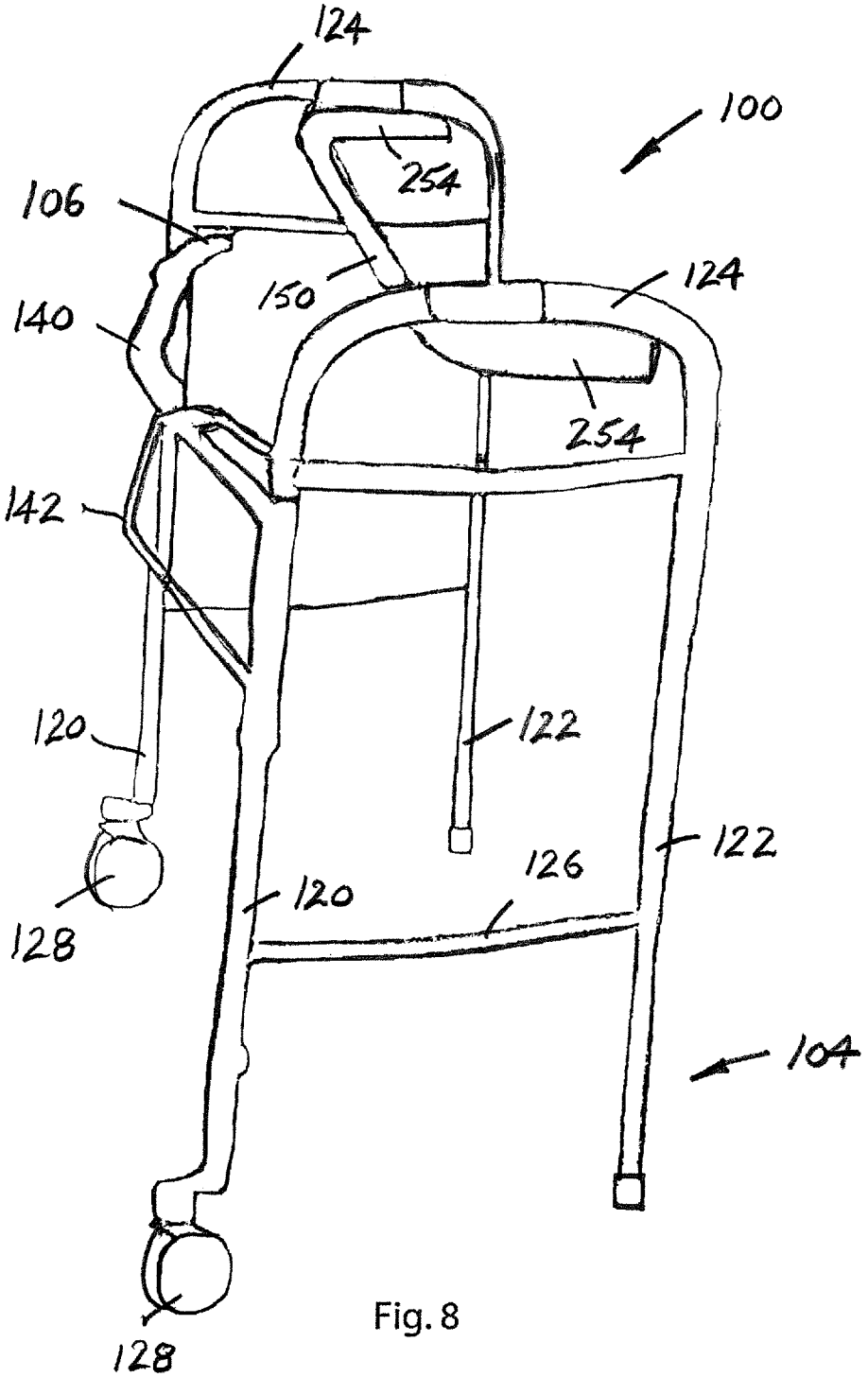
FIG. 8 illustrates a prototype torso bar front wheeled walker (FWW) with swivel wheels, where the torso bar is positioned below a level of walker grip handles and the torso bar is secured in place, and the torso bar may be variably positioned on the upper surface of the side frame top rail.

An assistive walking device such as front wheeled torso bar prototype walker 100 is presented in FIG. 8. The walker 100 has a typical walker structure, i.e. side frame portions have front and rear legs 120, 122 and an upper side frame rail 124, as well as an interconnecting side frame rail(s) 126, and first and second front frame portions 140, 142 that interconnect the side frame portions. Wheels 128 are provided on the terminal ends of the front legs 120, while the rear legs 122 do not have wheels. The torso bar 150 is a single straight tube with short perpendicular sections of tubing 254 son each of the two ends of the torso bar for attachment to the underside of the top rail 124 of the side frame portions 104, 106. Variably, the torso bar 150 could be attached to the top of the upper side frame rails 124. It is also contemplated that the torso bar 150 could include anterior and posterior portions configured to engage anterior and posterior portions of the torso of an associated user. For example, a belt (not shown) could be used to urge the associated user against the torso bar 150, or the torso bar can be formed as multiple portions, such as shown and described below with respect to FIG. 10, FIGS. 12A-12D, or FIGS. 13A-13B.

Figure 9:
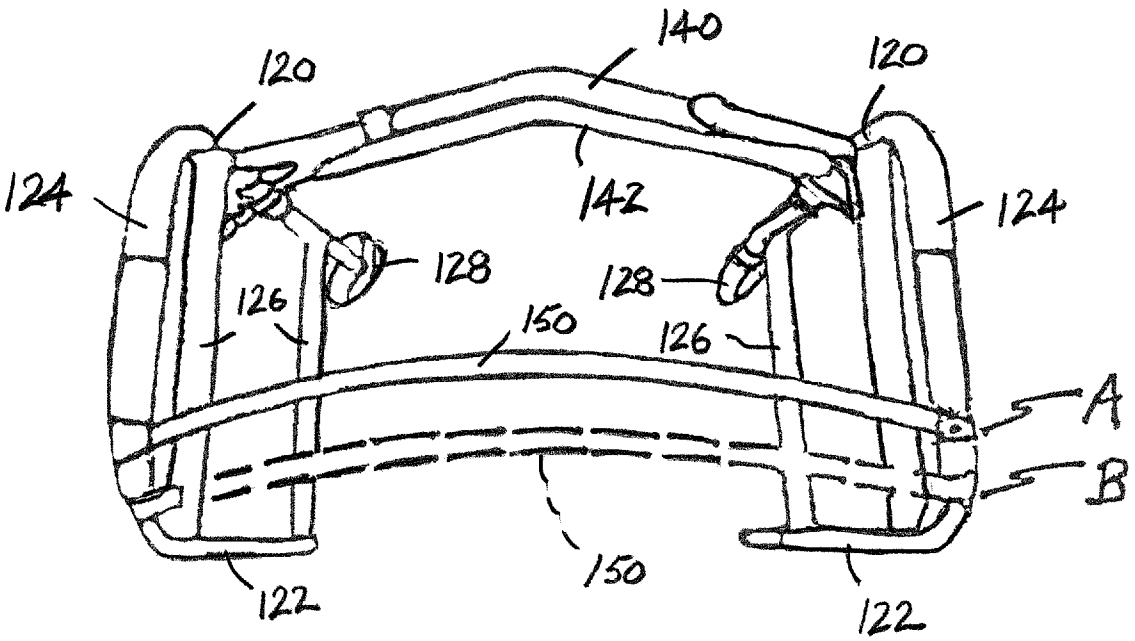
FIG. 9 is a bird's eye view of a FWW wherein the the torso bar may be variably positioned fore-aft, e.g., where the torso bar is in position A (positioned more forwardly) and the dotted line showing depicts an alternate, more rearward positioning (position B) of the torso bar.

FIG. 9 is an illustration of a design superimposed on an assistive walking device such as a front wheeled walker 100. Again, the walker 100 is a tubular frame arrangement such as the type shown and described in connection with FIG. 8 (which description is omitted here for purposes of brevity), offering variable fore-aft positioning of a one-piece torso bar 150. Any of several different attachment mechanisms can be incorporated for securing the ends of the torso bar 150 at symmetrical locations along the top rails 124 of side frames 104, 106. Positioning the torso bar 150 closer to the closed end of the frame 102 (position A) places the user's feet more forward within the walker 100 one compared with alternative position B shown in broken lines. It is also contemplated that the torso bar 150 could include anterior and posterior portions configured to engage anterior and posterior portions of the torso of an associated user. For example, a belt (not shown) could be used to urge the associated user against the torso bar 150, or the torso bar can be formed as multiple portions, such as shown and described below with respect to FIG. 10, FIGS. 12A-12D, or FIGS. 13A-13B.

Figure 10:
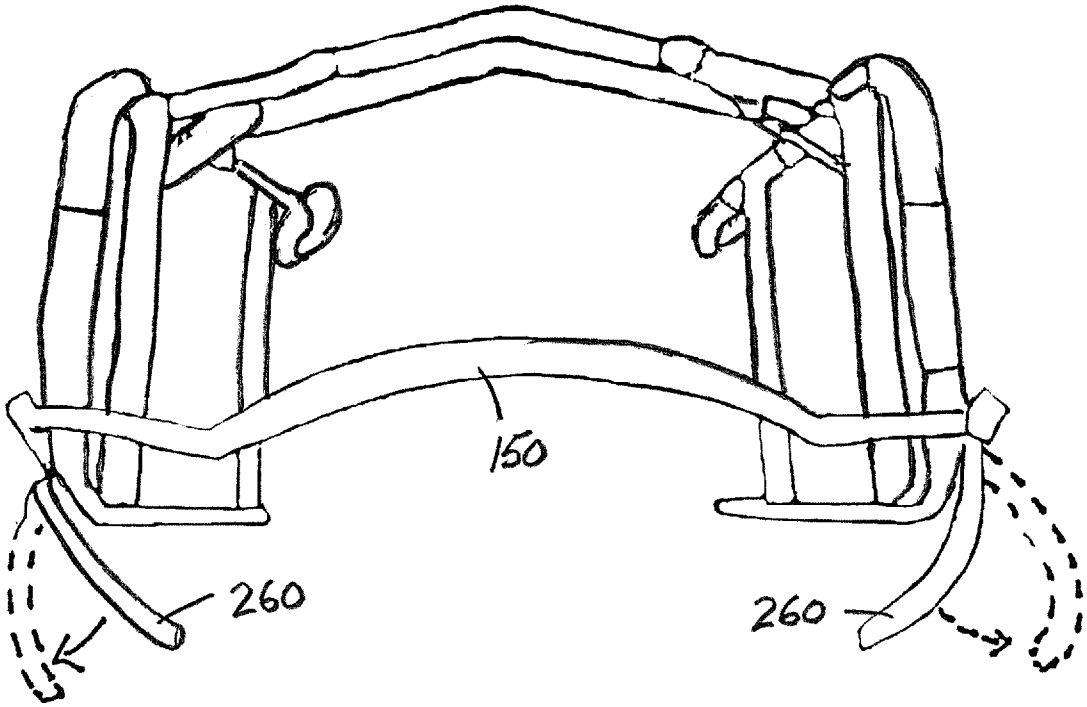
FIG. 10 is a bird's eye view of a FWW showing a torso bar contoured for improved fit around an associated user's anterior torso, and illustrated with rear flanges/pads that are 'posterior members' and can be used instead of a belt for assisting to maintain bodily positioning adjacent to the torso bar.

A design of a uniquely shaped torso bar 150 for enhanced conformity to the anterior torso and that also includes first and second anterior engaging portions 260 of the torso bar are illustrated in FIG. 10 and superimposed on a frame 102 of an assistive walking device such as a standard front wheeled walker 100. One can conceive that multiple torso shapes and sizes could be accommodated by multiple configurations of such a torso bar 150, 260. As an option to incorporating a belt (not shown), a straight or curved flange 260 extends from each side frame portion, having a limited length in the illustrated embodiment (although could have a more extended length if desired). The anterior engaging portions 260 could be fixedly mounted but are preferably pivotally mounted for rotation into place around the side of the user and secured in place. Dotted lines are used to represent the positioning of these components 260 when the device 100 is not in use or when the posterior members 260 are otherwise disengaged. Another option would be to incorporate a single curved tube instead of the belt or the posterior member portions, hinged at one end and detachable at the other end.

Figure 11:
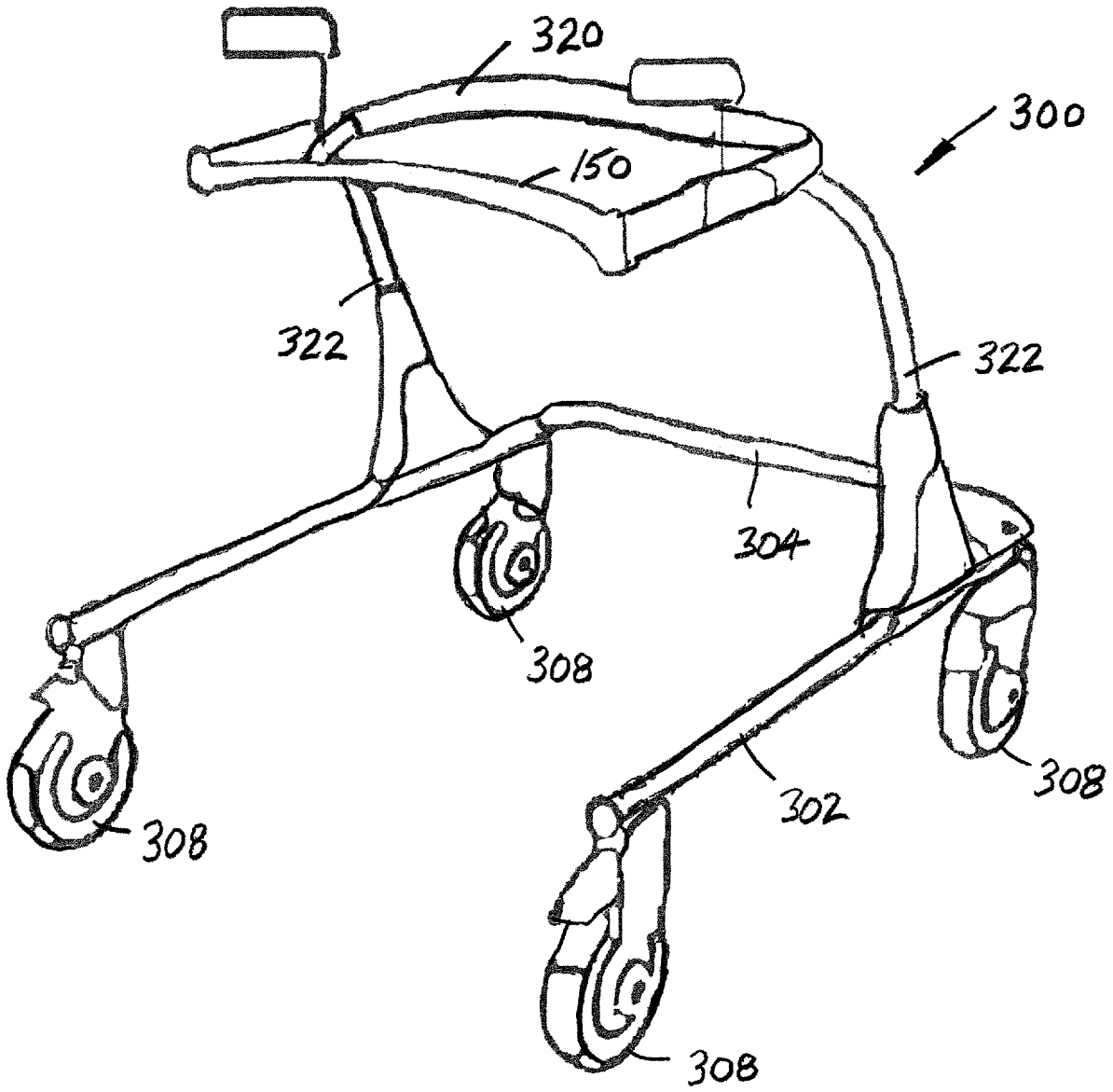
FIG. 11 is a posterolateral view of a gait trainer frame with a conceptual showing of a torso bar positioned between rear ends of the U-shaped upper frame.

An assistive walking device such as anterior gait trainer 300 is shown in FIG. 11. The user faces the closed end of the three-sided frame members 302, 304, 306. The frame includes four swiveling or caster wheels 308, and a generally U-shaped top rail 320 connected to the three-sided frame, and in this particular instance includes side support members 322 that extend between frame members 302, 306 and the top rail 320. A drawing of a curved torso bar 150 connecting the ends of the U-shaped top rail has been included. Any of several methods to secure the ends of the removable torso bar 150 to the frame could be integrated. It is also contemplated that the torso bar 150 could also include an anterior portion(s) configured to engage anterior regions of the torso of an associated user. For example, a belt (not shown) could be used to urge the associated user against the torso bar 150, or multiple portions, similar in design such as shown and described below with respect to FIG. 10, FIGS. 12A-12D, or FIGS. 13A-13B.

Illustrations of bilateral torso bar 150 designs are shown in FIGS. 12A-12D, again, the remainder of the assistive walking device (e.g. walker, rollator, etc.) includes reference numerals that conform to corresponding description above.

Figure 12A:
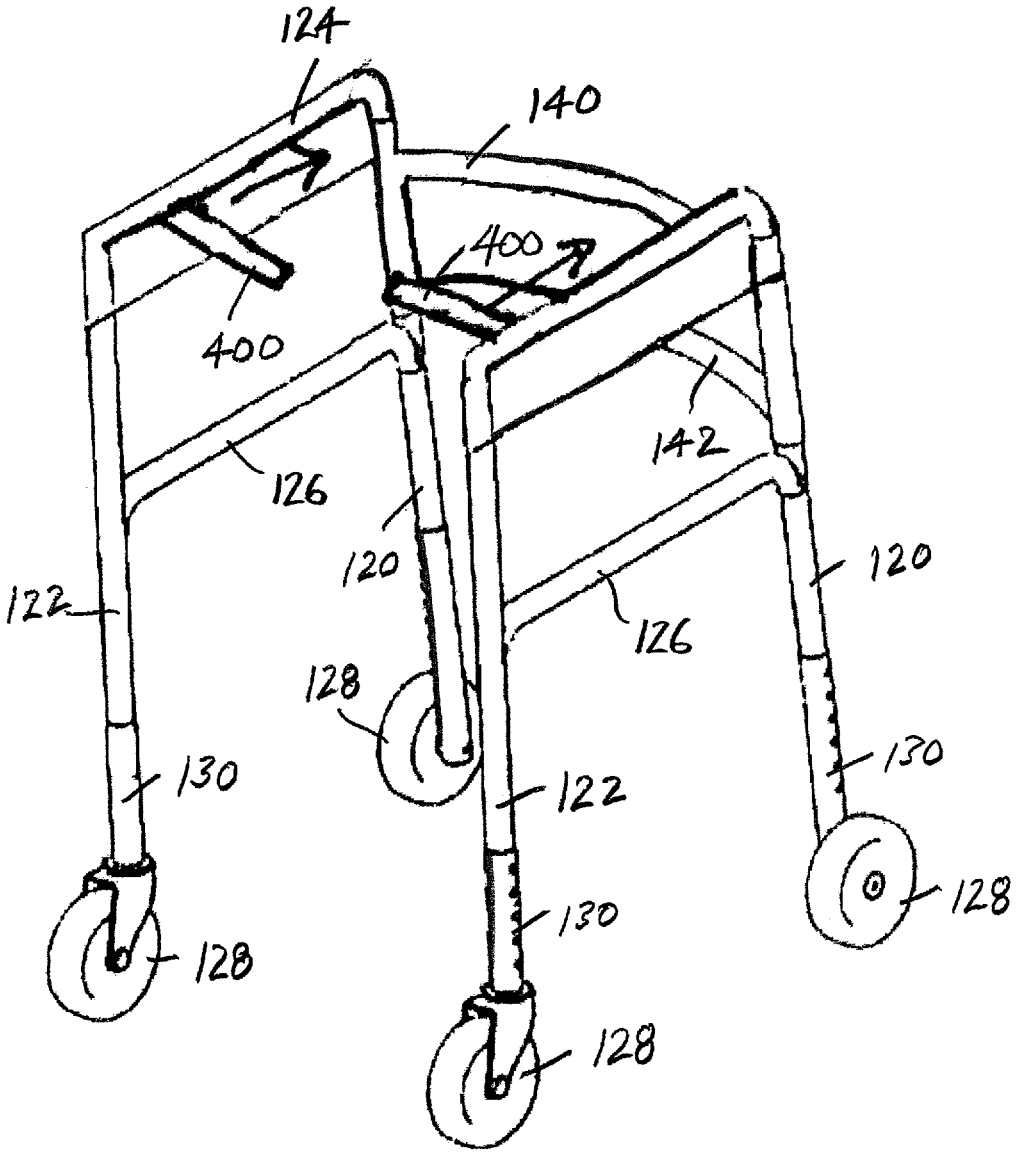
FIGS. 12A-12D represent designs of a wheeled device frame with different bilateral torso bar designs, one attached to each of the two side frames and each comprised of anterior or anterior and posterior members; and a belt or other one-piece posterior member can be variably incorporated such as FIG. 12A that shows straight bar bilateral torso bars, and dotted lines depict adjustable fore-aft positioning.

In FIG. 12A, horizontal members 400 project from the side frames 104, 106. Arrows represent fore-aft adjustability of these torso bars 400.

Figure 12B:
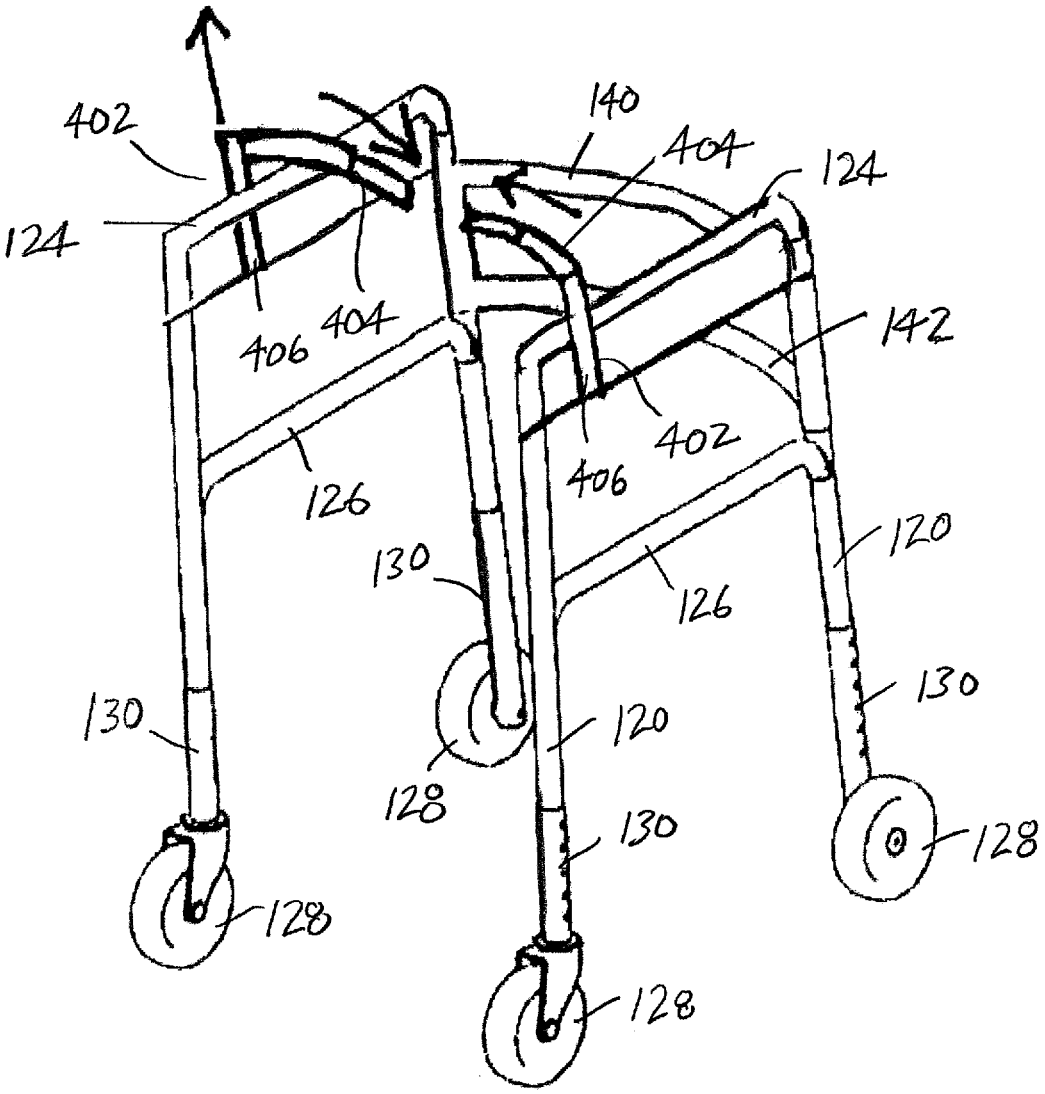

In FIG. 12B, curved torso bars 402 can be selectively lengthened by a telescoping tube member 404. The torso bars 402 can be readily adjusted vertically by vertical attachment members 406, depicted by vertical arrow above the torso bar 402 on the left. Rotation of the vertical attachment member/tube 406 (and subsequently securing in position) allows for fore-aft adjustment of user positioning within the frame.

Figure 12C:
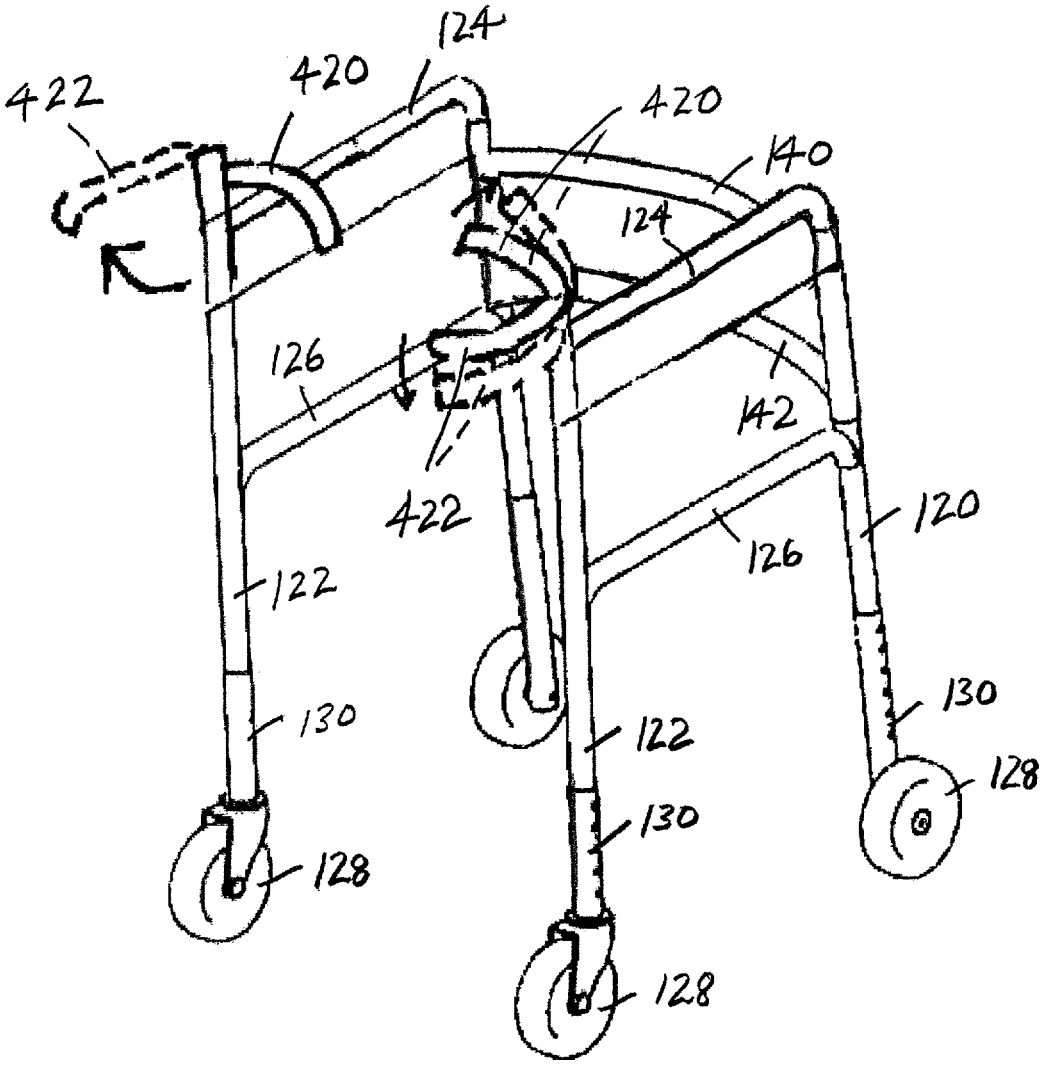

In FIG. 12C, a caliper design 420 is shown. Calipers 420 can be positioned to accommodate various pelvic girths and locked in position. Dotted lines on the left torso bar 420 show repositioning of the posterior caliper 422 in transverse plane to allow the user to get into or out of position relative to the frame.

Figure 12D:
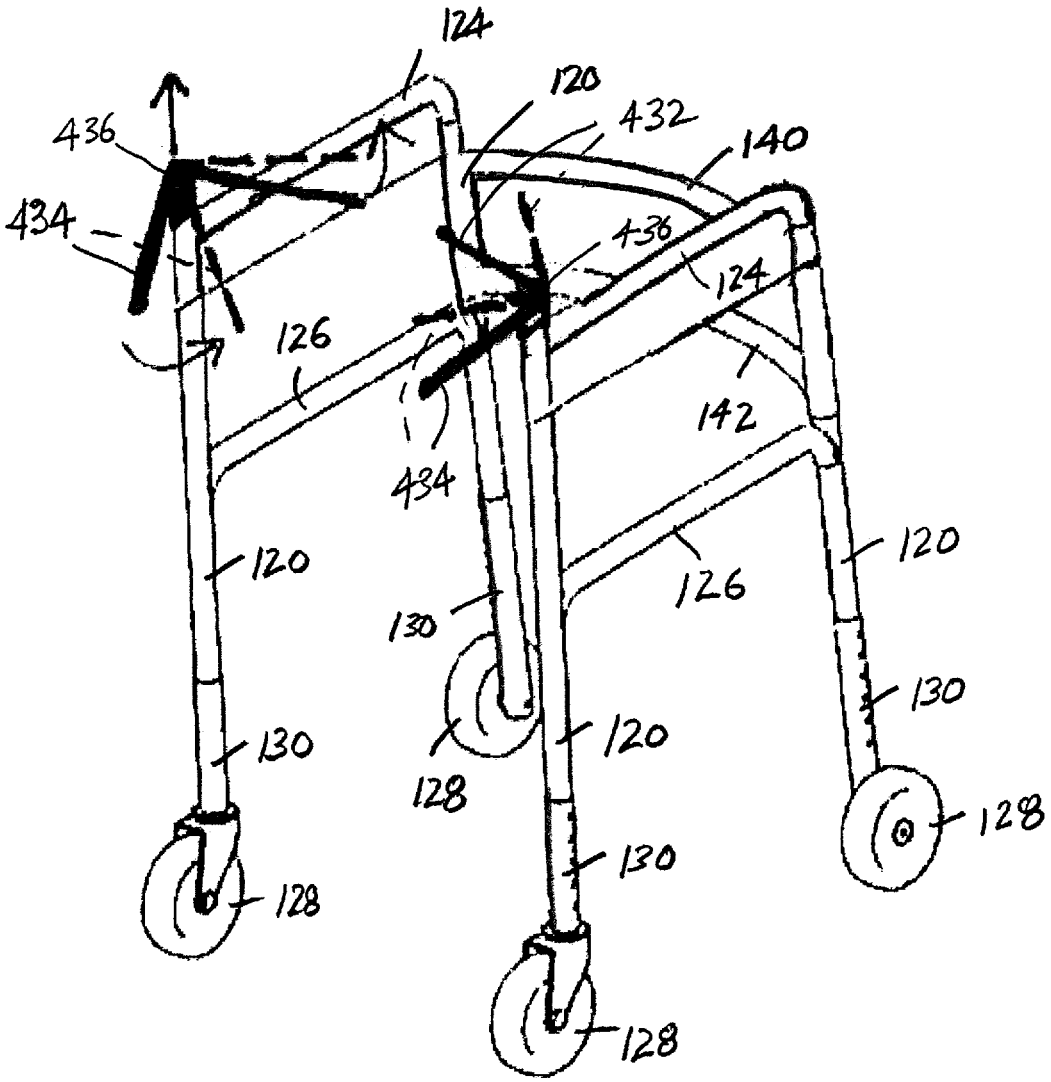

In FIG. 12D, a V-shaped design 430 is presented. Each torso bar 430 is comprised of two members 432, 434, both of which are positioned parallel to the ground. In use, the anterior member 432 contacts the anterior aspect of an associated user's torso, and the posterior member 434 contacts the posterior aspect. When in use, the rigid assembly 430 is statically positioned. The angle between the members 432, 434 could be fixed, or adjustable (e.g., one or both members 432, 432 could be adjusted). A vertical tube 436 attaches the assembly 430 to the frame and allows for vertical adjustment. Rotating the vertical tube 436 alters the direction that the open end faces, and thereby provides for different foot positioning of the associated user relative to the walker. The vertical tube 436 may also be locked in place.

Figure 13A:
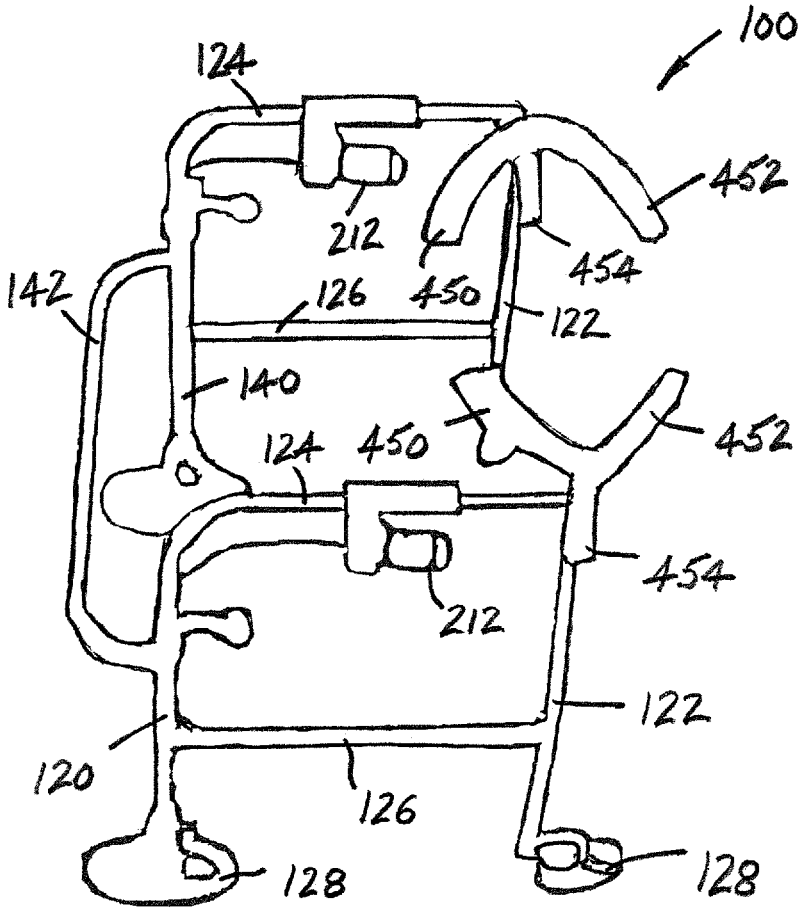
FIG. 13A is an image of a rollator prototype with an addition of bilateral U-shaped padded torso bars.
Figure 13B:
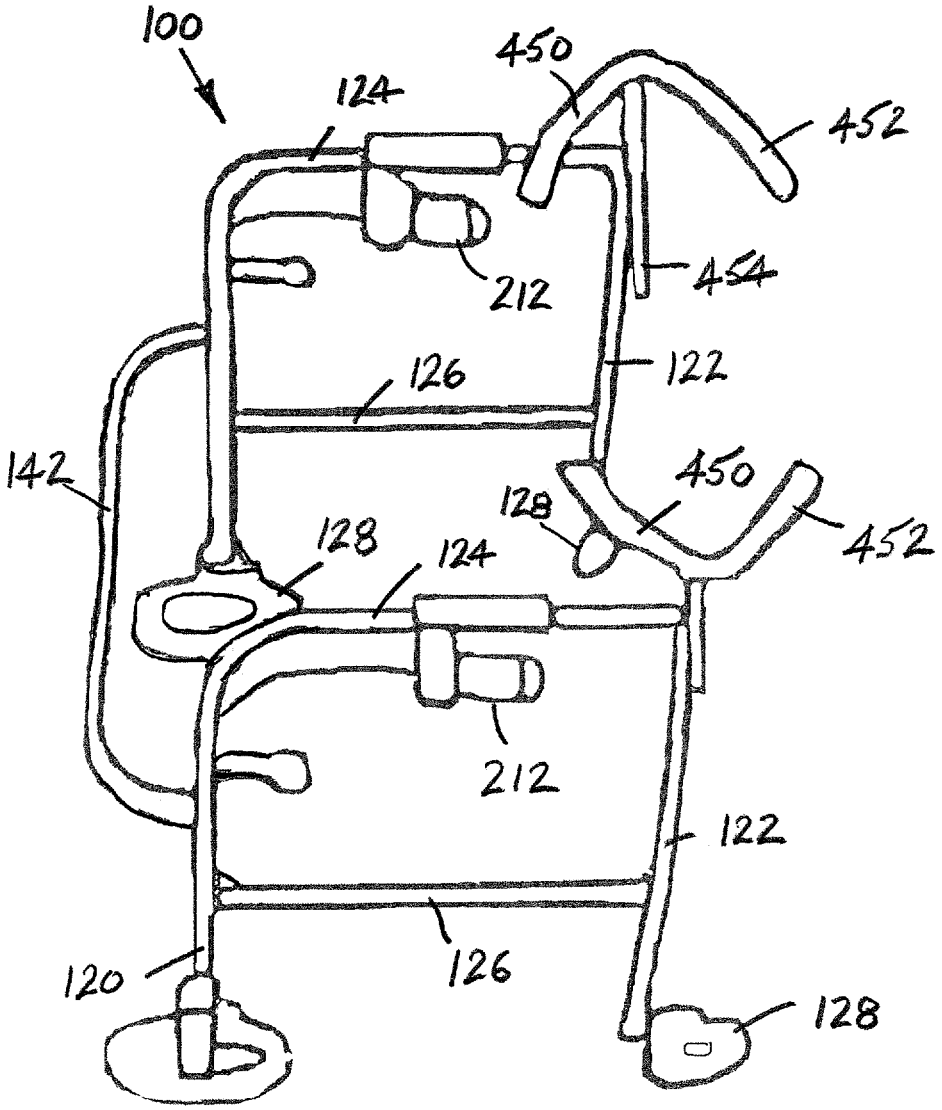
FIG. 13B is modified with torso bars adjusted for more cephalad positioning.

Design of U-shaped padded torso bars 450, 452 superimposed on a rollator is shown in FIGS. 13A and 13B. These padded torso bars are similar to the conceptual design illustrated in FIGS. 12C and 12D, the posterior member 452 of each of the torso bars serves to enhance bodily contact with the device 100. FIG. 13B illustrates the torso bars repositioned in a cephalad direction, such as could be done by adjusting the position of the vertical tube 454 within a clamp attached to frame 102.

An assistive walking device such as a rollator frame 460 with unique design is presented in FIGS. 14A-14D. Novel upper extremity 462 support surface designs are shown on one side of the device for ease of illustration. It is understood that handles 464 and forearm support assemblies 466 would be introduced bilaterally. Optionally, one forearm support assembly 466 and one grip handle assembly 464 could be introduced such that the user could support one forearm and support the opposite UE by gripping a grip handle.

The grip handle designs 462 may offer enhanced functionality compared to designs which involve gripping the upper rail of the frame. These novel designs may further reduce the tendency to manage the device with the UEs.

Straight or curved rails 470 comprise the top portion of the frame. The torso bar 150 is situated between the top rails and could be adjusted vertically and fore-aft.

Figure 14A:
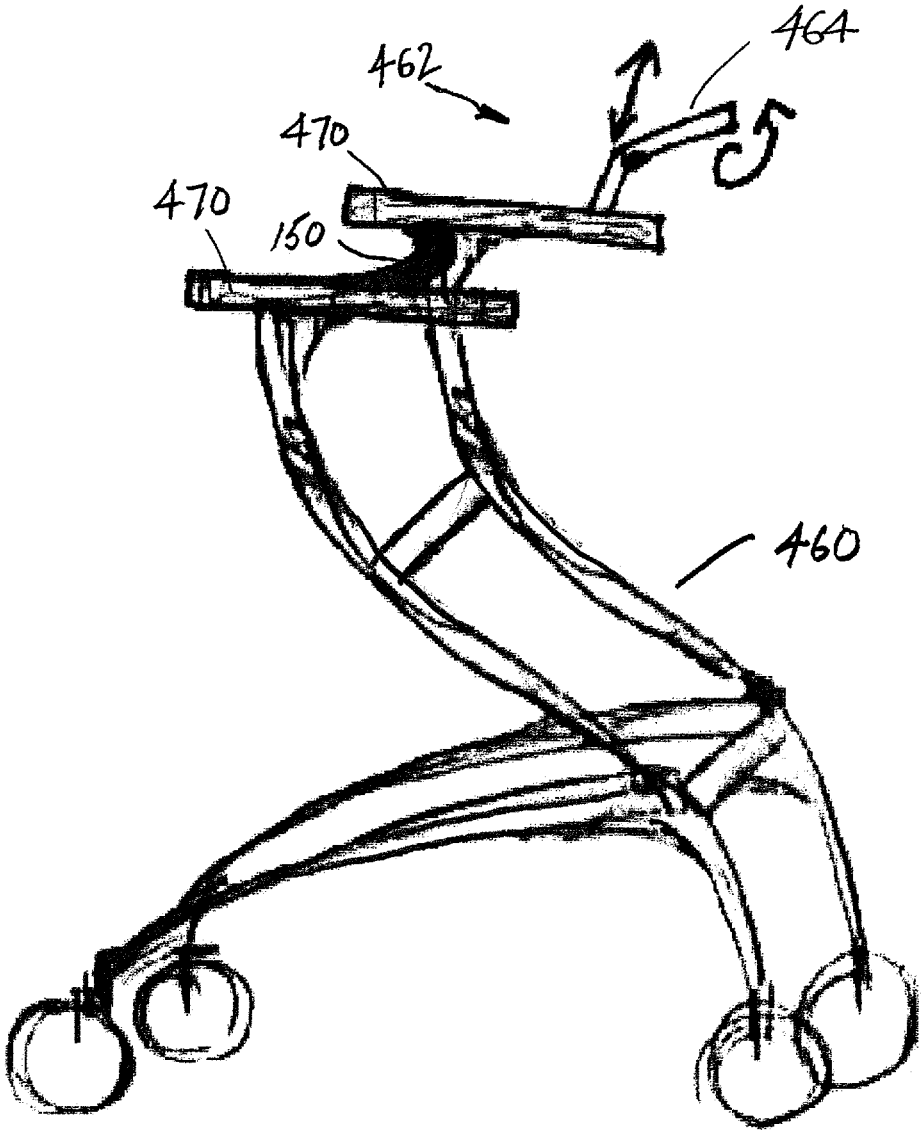
FIGS. 14A-14D show alternate frame designs incorporating a one-piece torso bar, specifically.

A vertical extension 470 is attached to the upper rail of the frame in FIG. 14A. Fore-aft position adjustment could be achieved such as by a gliding mechanism of this member integrated into the frame. A grip handle 464 is attached to the vertical extension by an adjustable hinge component or by a ball head component (represented by curved arrow) which would allow for unlimited wrist and hand positioning opportunities. Vertical adjustment is represented by the vertical arrow. Outward angulation of the grip handles 464 may be desirable for purposes of discouraging use of the UEs to push the device forward.

Figure 14B:
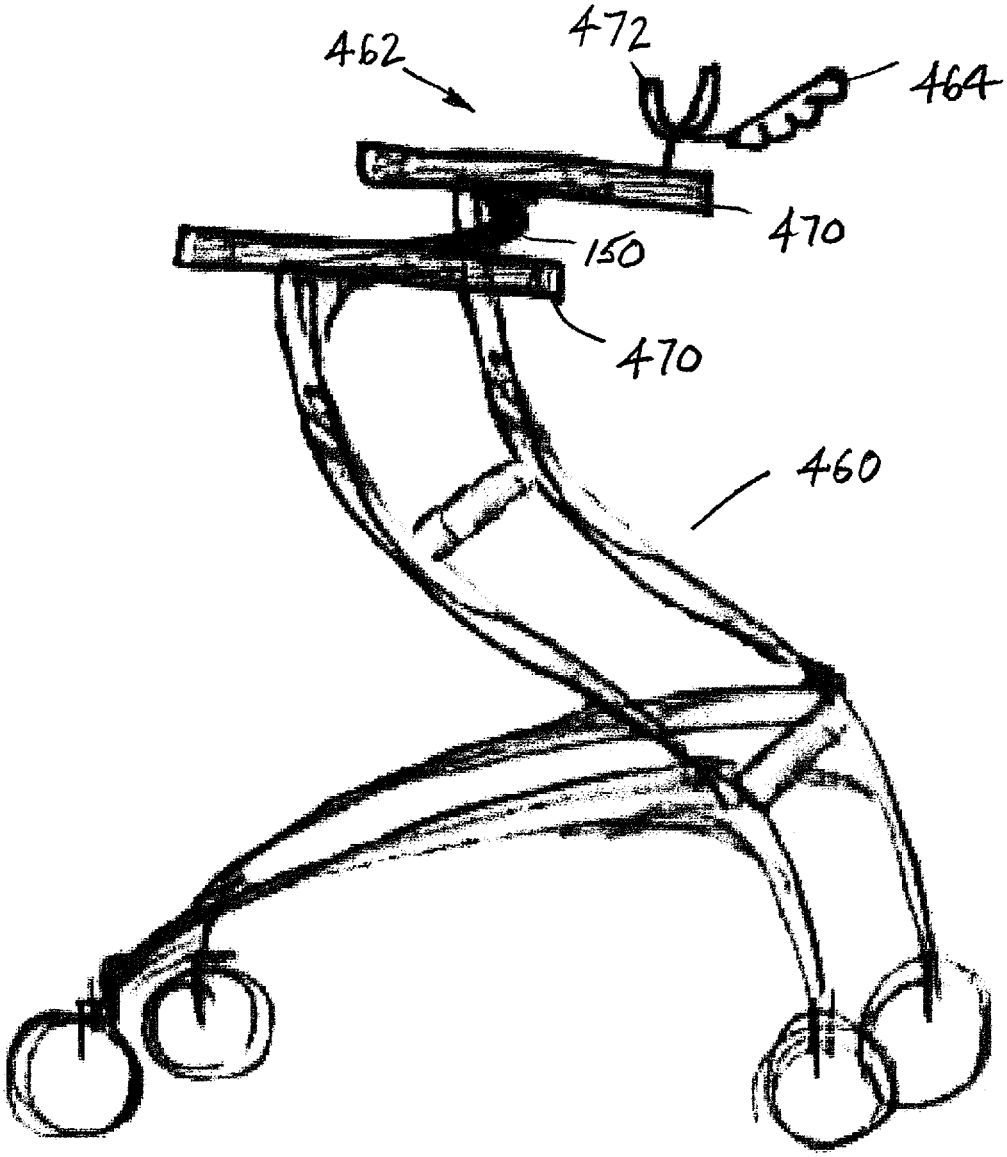

A U-shaped wrist support 472 is provided on the device illustrated in FIG. 14B. An adjustable grip handle 464 is attached to the wrist support assembly 472. A contoured grip handle 464 is illustrated. As with the device shown in FIG. 14A, the user would be encouraged to relax the upper extremity while gripping the handle 464.

Figure 14C:
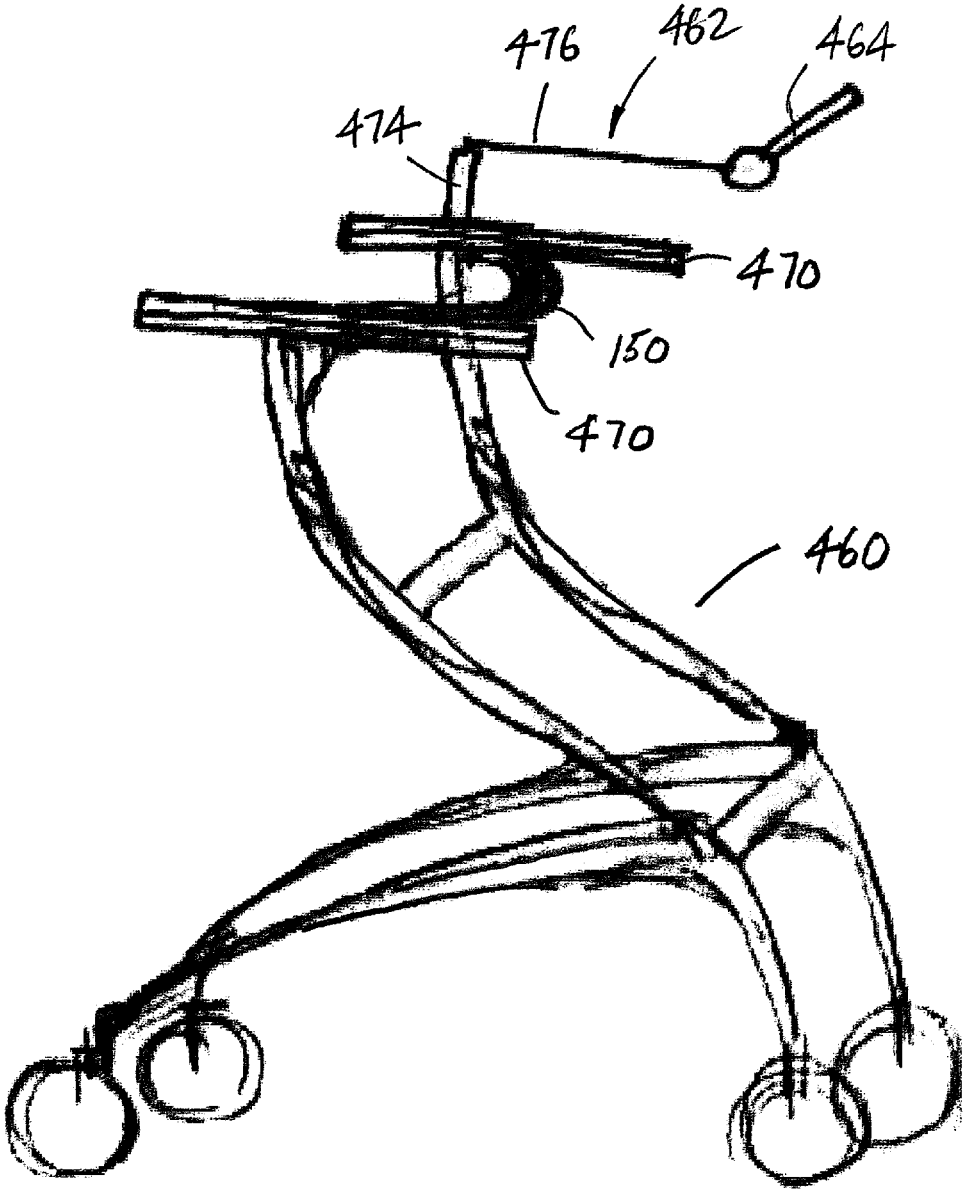

In FIG. 14C, an alternate method of attaching a grip handle 464 to the novel frame 460 is illustrated. A vertically adjustable tube 474 extends from the frame. A horizontal bar 476 is pivotally adjustable about the connection to the vertical member. A grip handle 464 is attached to the end of the horizontal bar.

Figure 14D:
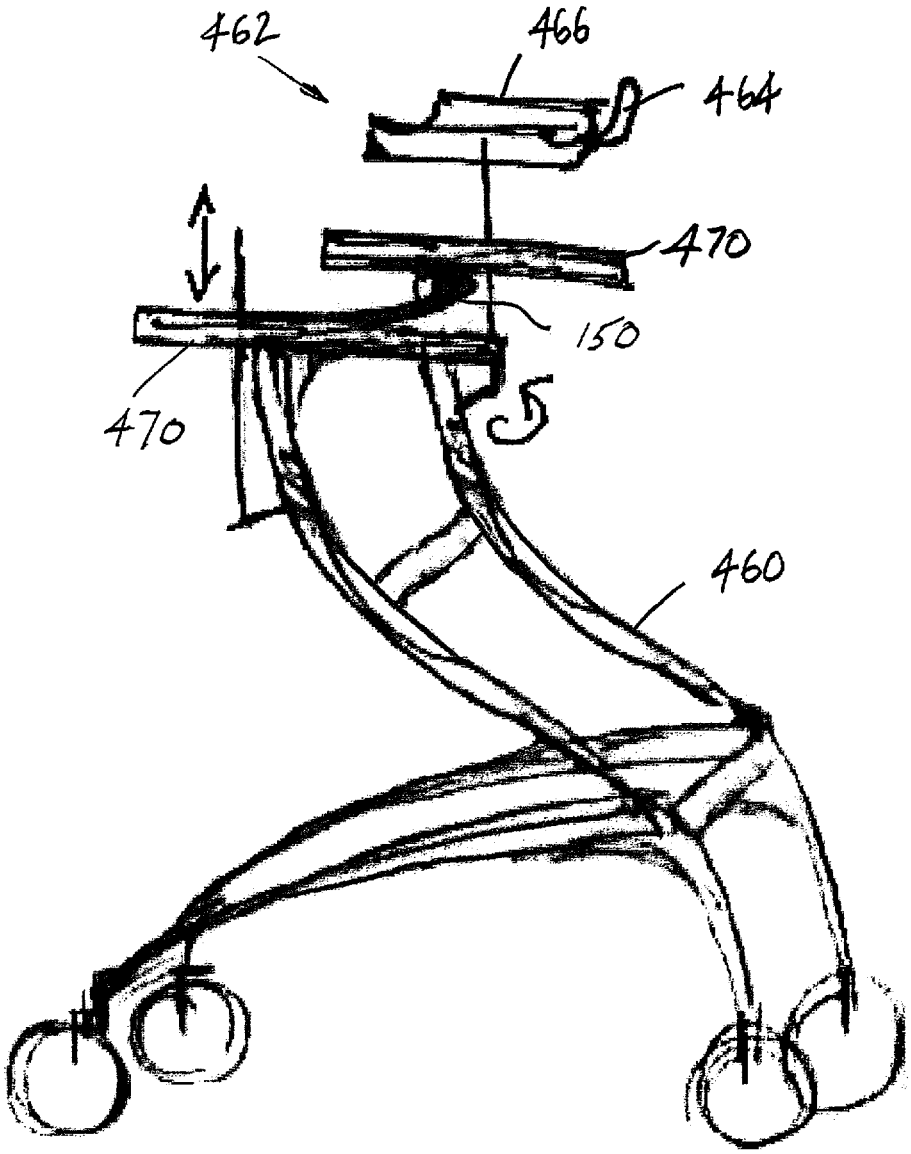

A torso bar rollator with forearm support assemblies 466 is illustrated in FIG. 14D. A horizontal component with pivotal adjustability in the transverse plane is attached to the frame below the upper rails. Forearm trough 466 and associated grip handle 464 are attached to a vertical component which could readily be height adjustable.

All of the terms used herein including technical or scientific terms have the same meanings as those generally understood by an ordinary skilled person in the related art unless they are defined otherwise. The terms defined in a generally used dictionary should be interpreted as having the same meanings as the contextual meanings of the relevant technology and should not be interpreted as having inconsistent or exaggerated meanings unless they are clearly defined in the various exemplary embodiments.

This written description uses examples to describe the disclosure, including the best mode, and also to enable any person skilled in the art to make and use the disclosure. Other examples that occur to those skilled in the art are intended to be within the scope of the invention if they have structural elements that do not differ from the same concept or that do not differ from the literal language of the claims, or if they include equivalent structural elements with insubstantial differences from the same concept or from the literal language of the claims. Moreover, this disclosure is intended to seek protection for a combination of components and/or steps and a combination of claims as originally presented for examination, as well as seek potential protection for other combinations of components and/or steps and combinations of claims during prosecution.

Although specific advantages have been enumerated above, various embodiments may include some, none, or all of the enumerated advantages. Although exemplary embodiments are illustrated in the figures and description herein, the principles of the present disclosure may be implemented using any number of techniques, whether currently known or not. Moreover, the operations of the systems and apparatuses disclosed herein may be performed by more, fewer, or other components, and the methods described herein may include more, fewer, or other steps. Additionally, steps may be performed in any suitable order.

To aid the Patent Office and any readers of this application and any resulting patent in interpreting the claims appended hereto, applicants do not intend any of the appended claims or claim elements to invoke 35 USC 112 (f) unless the words "means for" or "step for" are explicitly used in the particular claim.

What is claimed is:

1. An ambulatory aid comprising:

a frame having first and second side frame portions disposed in spaced, relation with one another in an operative position, the first and second side frame portions secured together by an interconnecting frame portion;

first and second wheels mounted to the frame to facilitate movement;

a torso bar configured for engagement with a torso of an associated user; and first and second upper extremity support surfaces on the first and second side frame portions, respectively, each configured to support a portion of an upper extremity of an associated user.

2. The ambulatory aid of claim 1 wherein the torso bar is a single member extending between the first and second side frame portions.

3. The ambulatory aid of claim 1 wherein torso bar is removably connected to the first and second side frame portions so that, when removed, the ambulatory aid can be pushed by the associated upper extremities of the associated user for upper body support for walking.

4. The ambulatory aid of claim 1 wherein the torso bar has either (i) a linear or (ii) curved configuration between first and second side frame portions thereof.

5. The ambulatory aid of claim 1 wherein the torso bar includes an anterior portion and a posterior portion configured to engage anterior and posterior torso regions of an associated user.

6. The ambulatory aid of claim 5 wherein the posterior portion is adjustable relative to the anterior portion.

7. The ambulatory aid of claim 1 wherein the torso bar is mounted via an adjustable mounting assembly to alter the torso bar vertically or in a fore/aft direction relative to the frame.

8. The ambulatory aid of claim 1 further comprising (i) a third wheel or (ii) third and fourth wheels.

9. The ambulatory aid of claim 1 further comprising an auditory cuing mechanism that provides an audible signal to the associated user.

10. The ambulatory aid of claim 1 further comprising a belt that is configured to secure the associated user against the torso bar.

11. The ambulatory aid of claim 1 wherein torso bar includes first and second portions, and each of the first and second torso portions includes an anterior portion and a posterior portion configured to engage anterior and posterior torso regions of an associated user.

12. The ambulatory aid of claim 11 wherein at least one of the first and second torso bar portions is adjustable relative to the first and second side frame portions, respectively.

13. The ambulatory aid of claim 1 wherein the torso bar includes first and second portions that are each pivotally connected to a respective side frame portion with a hinge that allows movement about one of a vertical axis or a horizontal axis.

14. A torso bar for an associated walker where the associated walker includes a frame having first and second side frame portions disposed in spaced relation with one another in an operative position, the first and second side frame portions secured together by a front frame portion, the torso bar comprising:

a curved or straight rigid bar having first and second ends spaced from one another, the first and second ends of the torso bar configured for mounting on the associated first and second side frame portions of the associated walker at a location rearwardly of the front frame portion, the torso bar configured for engagement with a torso of an associated user.

15. The torso bar of claim 14 wherein the torso bar includes first and second portions, each portion configured for mounting on the associated first side frame portion and second side frame portion, respectively, of the associated walker.

16. The torso bar of claim 14 further comprising a belt for urging the associated user toward the torso bar when the torso bar and belt are mounted to the associated walker.

17. The ambulatory aid of claim 1 wherein the torso bar includes distinct first and second members, the members securably connected to the first and second side frames, and medially displaced terminal ends of the first and second member are disposed in spaced relation.

18. The ambulatory aid of claim 1 further comprising either (i) first and second forearm support assemblies or (ii) first and second gripping surfaces located on the first and second side frame portions.

19. An assistive walking device for enhancing lower body stepping propulsive forces and erect posture for a user able to bear full weight on lower extremities, the assistive walking device comprising:

a frame having first and second side frame portions connected with an interconnecting member, each side frame portion configured for accepting a portion of an upper extremity of an associated user;

at least first and second wheels mounted to the frame for facilitating movement of the device; and a torso bar positioned between the first and second side frame portions and configured for propelling contact with an anterior torso of an associated user.

20. The walking device of claim 19 wherein a posterior member of the torso bar securably positions a torso of an associated user in consistent contact with an anterior member of the torso bar.

21. The walking device of claim 10 further comprising either (i) two forearm support assemblies or (ii) two gripping surfaces on the first and second side frame portions.

* * * * *